US007070267B2

(12) United States Patent
Yamaguchi et al.

(10) Patent No.: US 7,070,267 B2
(45) Date of Patent: Jul. 4, 2006

(54) LIQUID JET RECORDING HEAD AND LIQUID JET RECORDING APPARATUS

(75) Inventors: Yukuo Yamaguchi, Tokyo (JP); Yutaka Koizumi, Kanagawa (JP); Takeshi Yamakubo, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/356,509

(22) Filed: Feb. 3, 2003

(65) Prior Publication Data

US 2003/0156173 A1 Aug. 21, 2003

(30) Foreign Application Priority Data

Feb. 15, 2002 (JP) ..... 2002-039228

(51) Int. Cl.
*B41J 2/175* (2006.01)

(52) U.S. Cl. ..... 347/93; 347/87

(58) Field of Classification Search ..... 347/85, 347/86, 87, 93; 210/488, 498
See application file for complete search history.

(56) References Cited

U.S. PATENT DOCUMENTS 5,502,479 A * 3/1996 Ishinaga et al. ..... 347/93
5,552,816 A * 9/1996 Oda et al. ..... 347/86
5,940,957 A 8/1999 Goto et al.
6,120,139 A * 9/2000 Childers et al. ..... 347/92
6,234,615 B1 * 5/2001 Tsukuda ..... 347/85
6,267,251 B1 * 7/2001 Sullivan ..... 210/488
6,302,534 B1 * 10/2001 Tsukahara et al. ..... 347/86
6,328,424 B1 * 12/2001 Denton et al. ..... 347/50
6,338,552 B1 * 1/2002 Sato et al. ..... 347/85
6,406,137 B1 6/2002 Okazaki et al.
6,520,630 B1 * 2/2003 Oda et al. ..... 347/85
6,530,654 B1 * 3/2003 Kitabatake et al. ..... 347/86
6,637,872 B1 * 10/2003 Ara et al. ..... 347/85
2002/0012021 A1 1/2002 Umeyama et al.
2003/0016278 A1 1/2003 Yamaguchi et al.

OTHER PUBLICATIONS

U.S. Appl. No. 10/359,055, filed Feb. 6, 2003, Yukuo Yamaguchi et al.
U.S. Appl. No. 10/361,615, filed Feb. 11, 2003, Yukuo Yamaguchi et al.
U.S. Appl. No. 10/361,621, filed Feb. 11, 2003, Yukuo Yamaguchi et al.
U.S. Appl. No. 10/366,477, filed Feb. 14, 2003, Yukuo Yamaguchi et al.

* cited by examiner

*Primary Examiner*—Anh T. N. Vo
(74) *Attorney, Agent, or Firm*—Fitzpatrick, Cella, Harper & Scinto

(57) ABSTRACT

A liquid discharge head includes recording liquid flow paths communicated with plural discharge ports, a flow path formation member, upstream of the recording liquid flow paths, on which a recording liquid supply passage is provided, a recording liquid storing member, upstream of the recording liquid supply passage, in which a common liquid chamber is provided, a plug member for supplying recording liquid from the outside into the common liquid chamber, and a porous member at the end portion of the flow path formation member to remove dust particles and the like in recording liquid supplied from the common liquid chamber to the recording liquid supply passage. The porous member is arranged above a bottom face of the common liquid chamber.

4 Claims, 14 Drawing Sheets

LIQUID JET RECORDING HEAD AND LIQUID JET RECORDING APPARATUS

BACKGROUND OF THE INVENTION

1. Field of the Invention

The present invention relates to a liquid jet recording head that forms liquid droplets by discharging liquid, such as recording liquid, from discharge ports (orifices), and also, the invention relates to a recording apparatus provided with such a liquid jet recording head.

In this respect, even among ink generally considered dyestuffs ink, there are inks that eventually precipitate colorant. For the present invention, it is to be understood that ink that eventually precipitates colorant, including dyestuffs ink of the kind, is called collectively pigment ink.

2. Related Background Art

A recording apparatus that mounts a liquid jet recording head can be cited as a typical recording apparatus that adopts a liquid jet recording method, a method which makes it possible to perform high-speed recording and to record on various kinds of recording media.

For the liquid jet recording head of the kind, the method of discharge that uses an electrothermal converting element is known as the typical discharge method, in which liquid droplets are discharged from fine discharge ports for recording on a recording medium. The liquid jet recording head generally comprises a liquid jet recording head that records on a recording medium by discharging recording liquid from discharge ports, and a recording liquid storing chamber that contains recording liquid to be supplied to the liquid jet recording head.

Now, as the recording liquid, which is discharged from the aforesaid liquid jet recording head, there is primarily dyestuffs ink and pigment ink.

Unlike dyestuffs ink, in which the colorant is dissolved, pigment ink has large colorant grains, and it has the advantage that discoloration does not occur easily, because it is excellent in light resistance when exposed to light after recording. On the other hand, the colorant in the ink settles more easily, and if the pigment settles and is separated, there is a fear that the densities of the object recorded by the liquid jet recording head are significantly degraded, and/or that clogging takes place in the discharge ports (orifices) of the liquid jet recording head.

Therefore, if pigment ink is stored in the liquid jet recording apparatus for a long time, there is a fear that the porous member, such as a filter, provided for the liquid supply passage for the purpose of removing impurities or dust particles in the recording liquid, may become clogged, or that the liquid supply passage itself may become clogged. Once a problem such as this occurs, ink is no longer able to reach the discharge port portion at the downstream end of the apparatus, thus preventing ink discharge from the discharge ports of the liquid jet recording head.

SUMMARY OF THE INVENTION

Now, therefore, it is an object of the present invention to provide a liquid jet recording head that makes it difficult for recording liquid discharges to be prevented due to the clogging of the porous member arranged inside the common liquid chamber, and also, to provide a recording apparatus provided with such a liquid jet recording head.

In order to achieve the aforesaid object, the liquid discharge head of the present invention comprises:

recording liquid flow paths communicated with plural discharge ports for discharging liquid droplets;

a flow path formation member upstream of the recording liquid flow path in which a recording liquid supply passage for supplying recording liquid to the recording liquid flow path is provided;

a recording liquid storing member upstream of the recording liquid supply passage in which a common liquid chamber for containing recording liquid to be supplied to the recording liquid supply passage is provided;

a plug member for supplying recording liquid from the outside into the common liquid chamber; and a porous member held at an end portion of the flow path formation member to remove dust particles and other matter in recording liquid supplied from the common liquid chamber to the recording liquid supply passage. In this liquid jet recording head, the porous member is arranged above a bottom face of the common liquid chamber.

Recording liquid is supplied from the outside into the common liquid chamber, and then, recording liquid in the common liquid chamber is agitated to enable the colorant in the recording liquid, dust particles, and the like, accumulated on the surface of the porous member to ride and be carried by the flow of recording for the liquid jet recording head of the present invention described above. Thus, this matter is removed from the surface of the porous member, and there is no possibility for it to float again in the recording liquid, but rather it drops off to the bottom portion of the common liquid chamber. Here, the porous member is arranged above the bottom face of the common liquid chamber to make it difficult for the colorant, dust particles, and the like, accumulated on the bottom face of the common liquid chamber to accumulate on the surface of the porous member. In other words, the structure is arranged to make clogging of the porous member difficult.

Also, the plug member of the liquid jet recording head of the invention may be an elastic element arranged to deal with switching of the supply condition of recording liquid from the outside into the common liquid chamber between a supplying state and a non-supplying state.

Also, for the liquid jet recording head of the invention, the outer shape of the portion of the flow path formation member positioned toward the common liquid chamber may be formed to be cylindrical. In other words, the flow path formation member is configured so as to impede the flow of recording liquid as little as possible. In this manner, it is made easier to maintain the flow of recording liquid in the common liquid chamber for the removal of the colorant, dust particles, and the like, accumulated on the surface of the porous member.

Also, for the liquid jet recording head of the invention, the surface of the porous member is extruded to be spherical in the flow-in direction of recording liquid into the porous member. If the porous member were formed to be flat or formed with a recessed surface, this would present resistance to the carrying off of colorant and dust particles by the flow of the recording liquid, and the colorant and dust particles would not ride on the flow of the recording liquid when agitated, thus impeding the separation of these particles from the surface of the porous member. However, with the spherical extruded surface of the porous member, it becomes difficult to disturb the flow of recording liquid running on the surface of the porous member. As a result, colorant and dust particles can be removed from the surface of the porous member efficiently.

Further, for the liquid jet recording head of the invention, a pair of plug members may be formed including an upper plug member, becoming the exhaust passage for exhausting the air inside the common liquid chamber, and a lower plug member, becoming the supply passage for supplying recording liquid from the outside. Also, the porous member may be arranged near the lower plug member. Further, the distance from the porous member to the lower plug member, which is provided for the side face of the recording liquid storing member, may be smaller than the distance from the porous member to the side face having the lower plug member provided therefor. In this case, the porous member is positioned in the location where the flow of recording liquid is vigorous. Therefore, colorant and dust particles on the surface of the porous member can be removed efficiently.

Also, for the liquid jet recording head of the invention, at least the height from the bottom face to the porous member may be arranged to be greater than the height from the bottom face to the lower plug arranged for the side face of the recording liquid storing member.

Further, the liquid jet recording head of the invention may comprise an electrothermal converting element for generating thermal energy used for discharging recording liquid, particularly, one by which recording liquid is discharged from the discharge ports by utilization of film boiling generated in recording liquid by thermal energy applied to the electrothermal converting element.

The liquid jet recording apparatus of the present invention may be such that it is provided with the aforesaid liquid jet recording head, and comprises:

a carriage for detachably mounting the liquid jet recording head;

a recording liquid storing tank provided outside the carriage for storing recording liquid to be supplied to the common liquid chamber of the liquid jet recording head; and supply means for supplying recording liquid stored in the recording liquid storing tank to the common liquid chamber through either one of the plug members.

As described above, the liquid jet recording apparatus of the invention can record with the liquid jet recording head having the porous member that is not easily clogged, thus making it possible to prevent recording from being disabled by non-discharges of recording liquid from the discharge ports of the liquid jet recording head due to the inability of recording liquid to reach the discharge port portion located at the downstream end of the apparatus.

BRIEF DESCRIPTION OF THE DRAWINGS

FIG. 9A shows the state where the needles are inserted; FIG. 9B shows that state where the needles are not inserted.

DETAILED DESCRIPTION OF THE PREFERRED EMBODIMENTS

Next, with reference to the accompanying drawings, the description will be made of the embodiments in accordance with the present invention.

Figure 1:
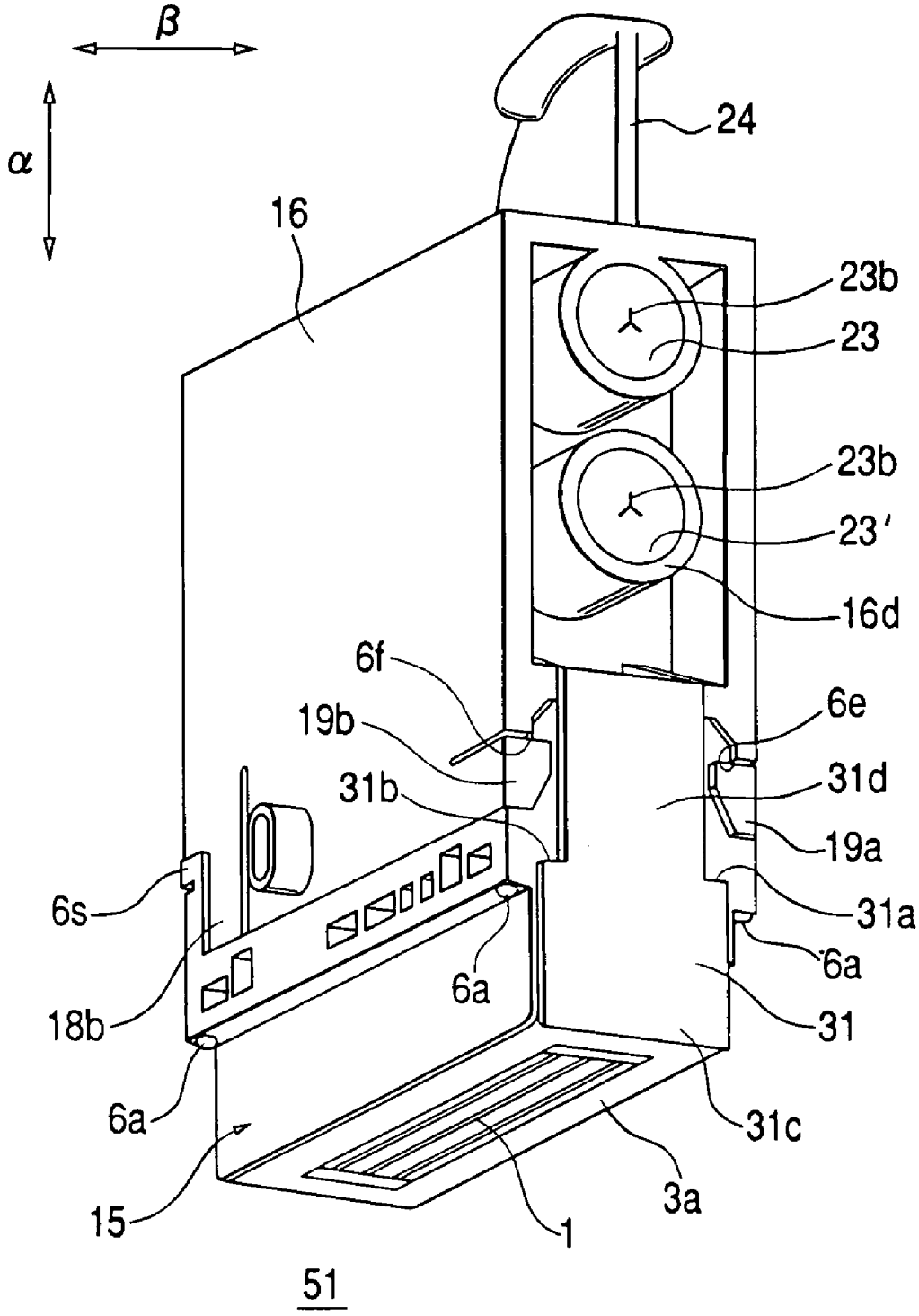
FIG. 1 is a perspective view that shows one example of the liquid jet recording head of the present invention, observed from the side where joint rubbers are provided to supply recording liquid.
Figure 2:
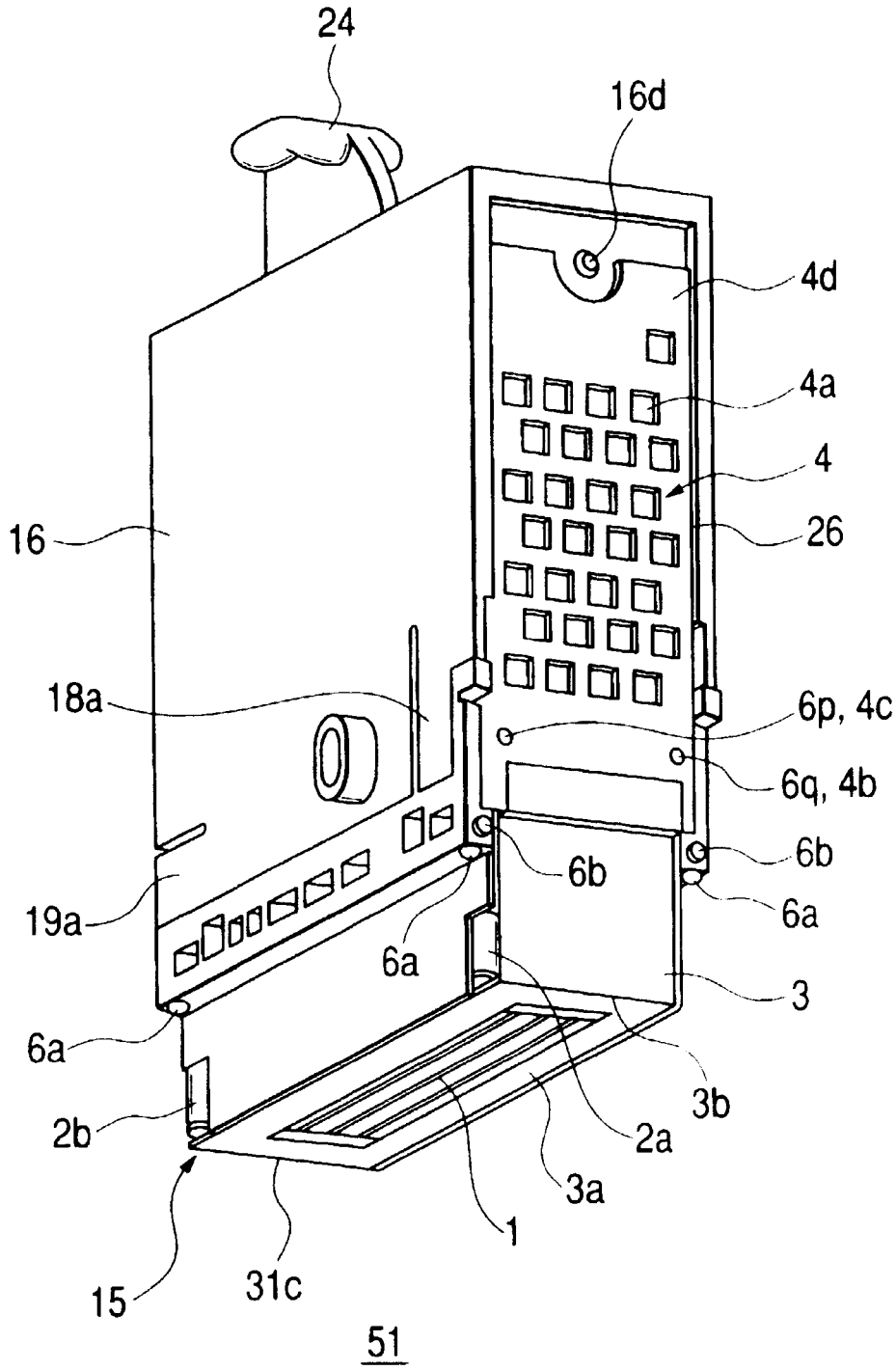
FIG. 2 is a perspective view that shows the liquid jet recording head represented in FIG. 1, observed from the side where a contact terminal wiring base plate is provided.
Figure 3:
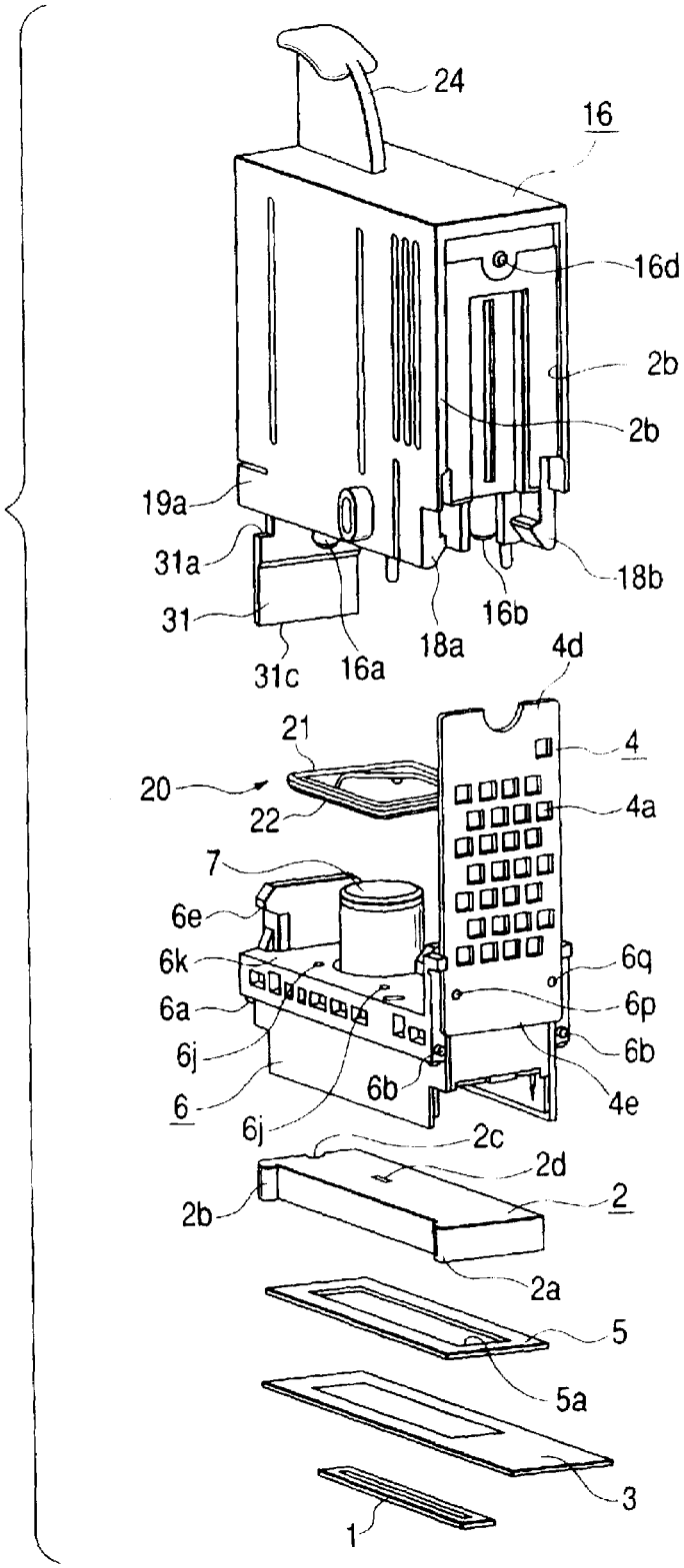
FIG. 3 is an exploded perspective view that shows the liquid jet recording head represented in FIG. 1.
Figure 4A:
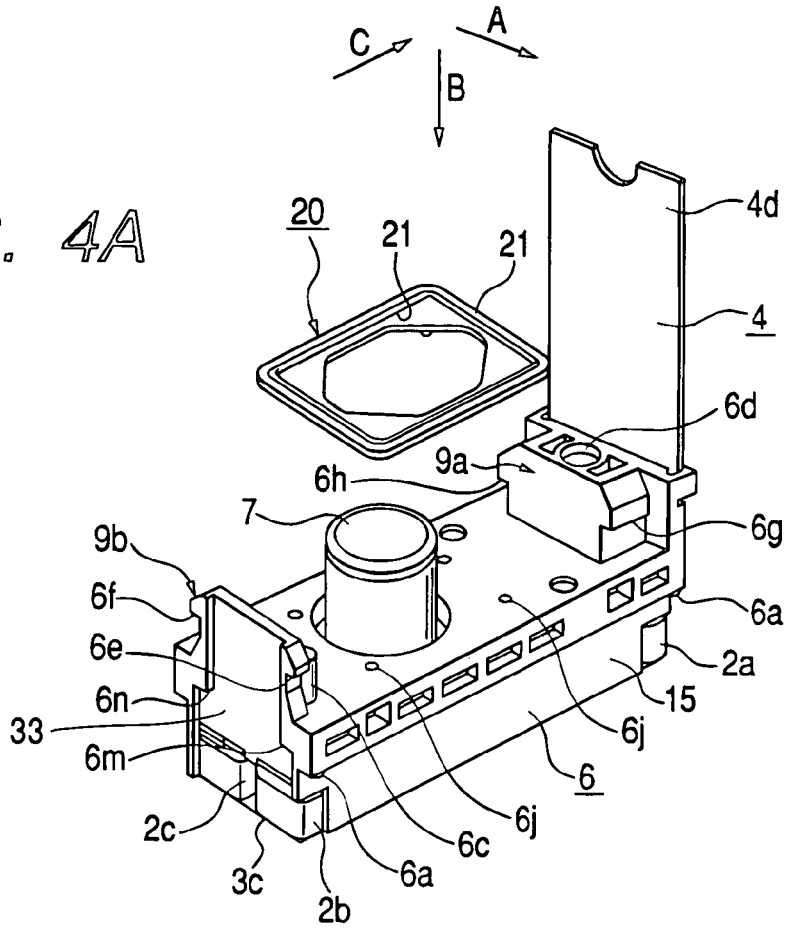
FIG. 4A is a perspective view that shows a flow path formation member from above.
Figure 4B:
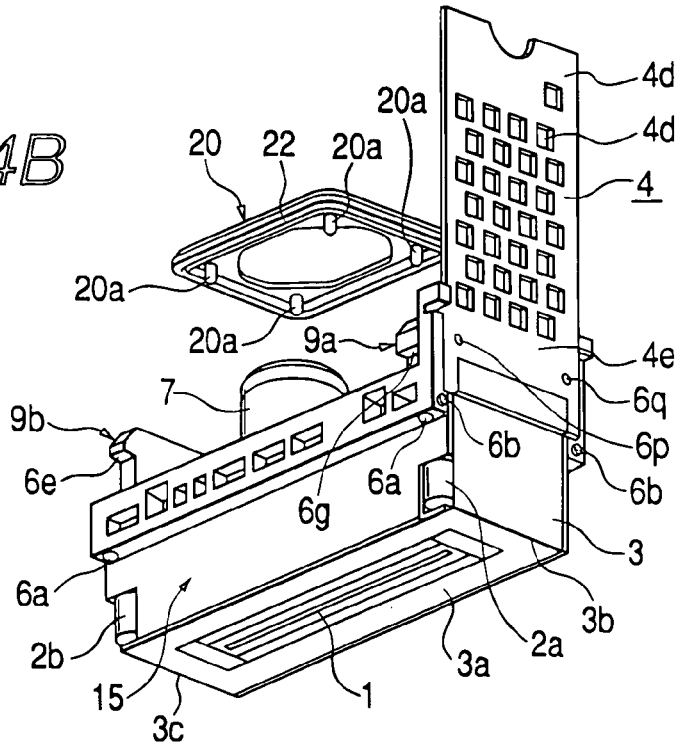
FIG. 4B is a perspective view that shows the flow path formation member from below.
Figure 5:
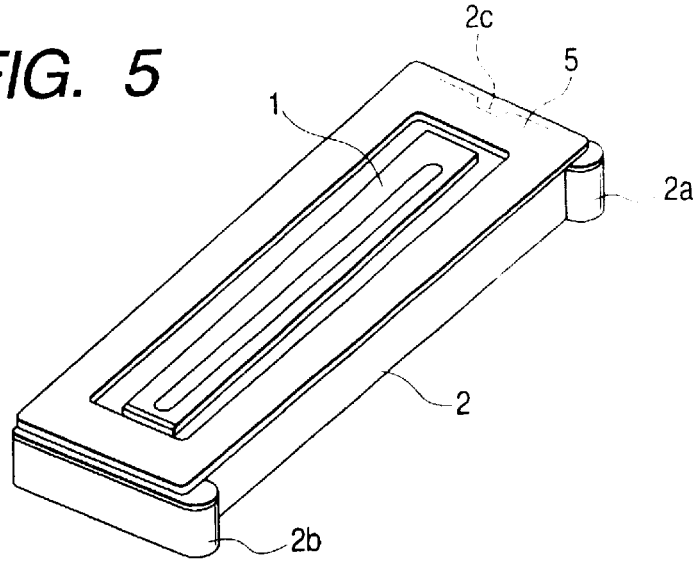
FIG. 5 is a perspective view that shows a recording element base plate and a first plate.
Figure 6:
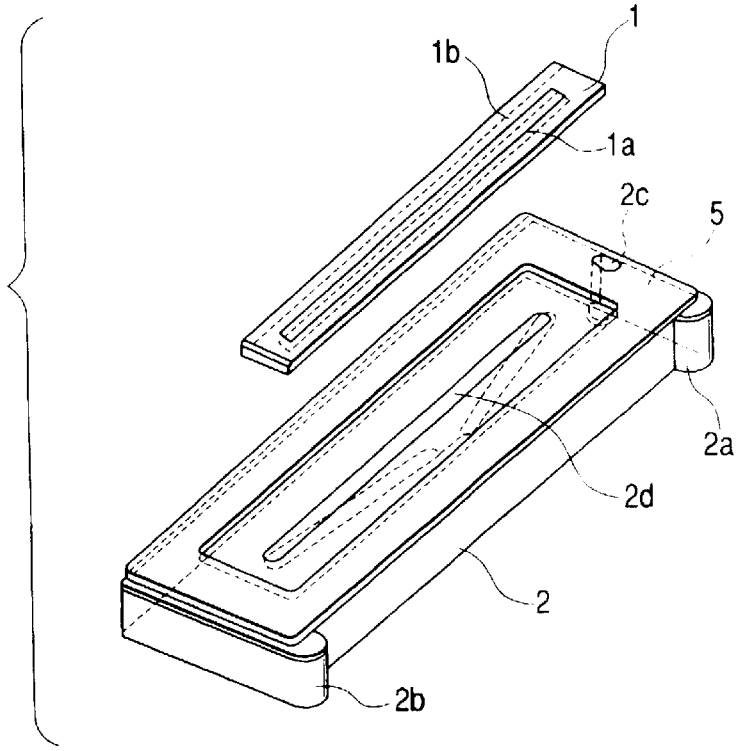
FIG. 6 is an exploded perspective view that shows the recording element base plate and the first plate.
Figure 7:
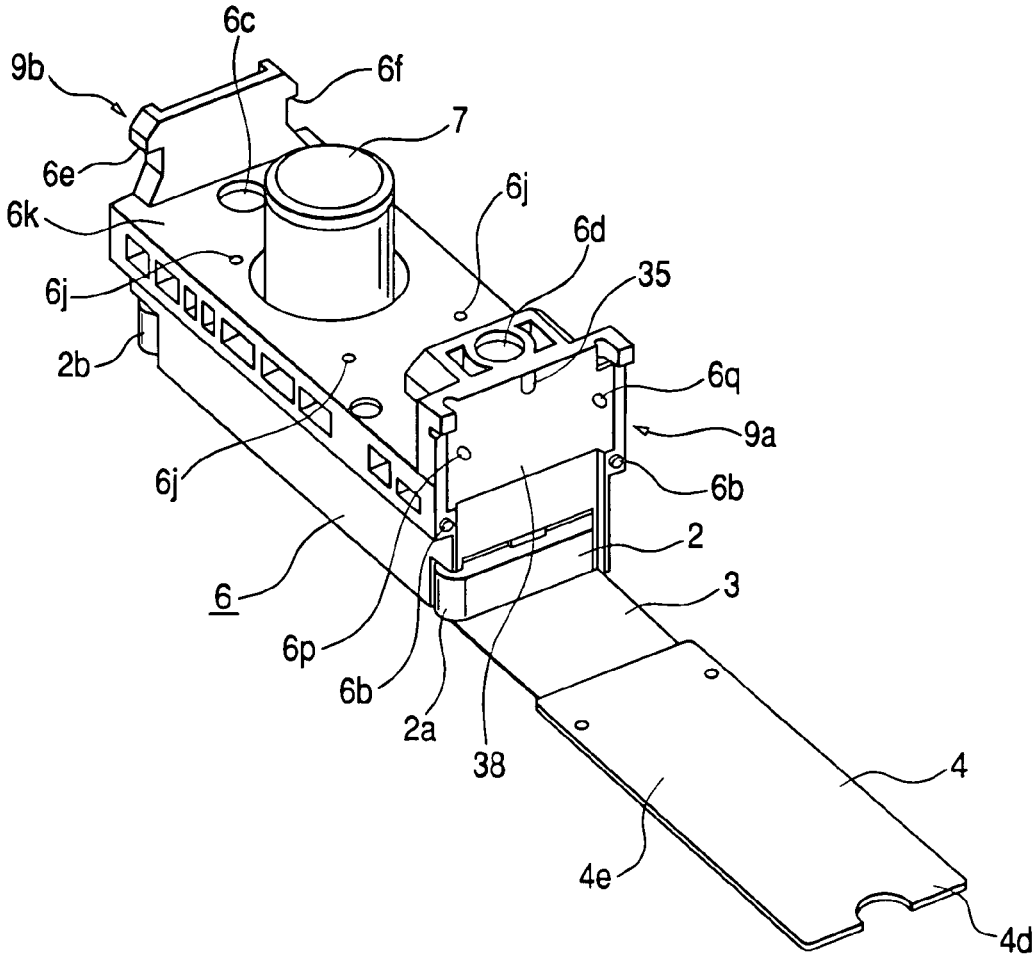
FIG. 7 is a perspective view that shows the flow path formation member from above without the installation of the contact terminal wiring base plate.
Figure 8:
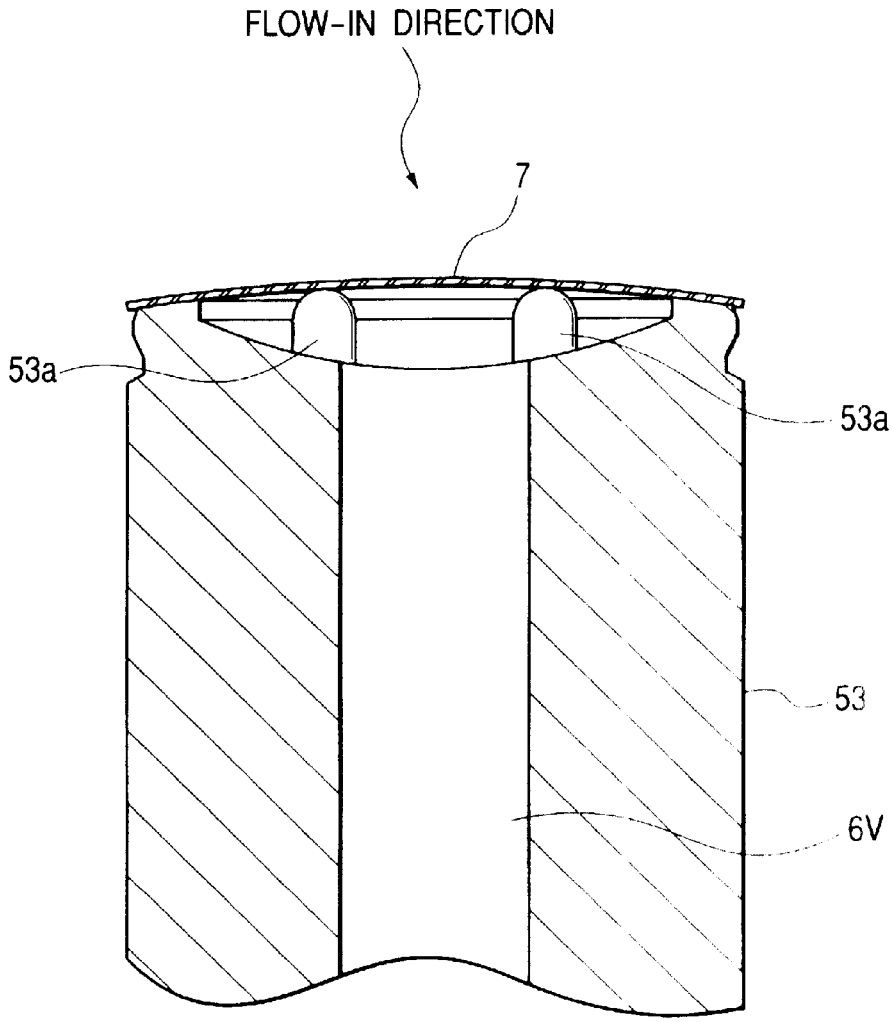
FIG. 8 is a side sectional view that shows the configuration of a porous member.
Figure 9B:
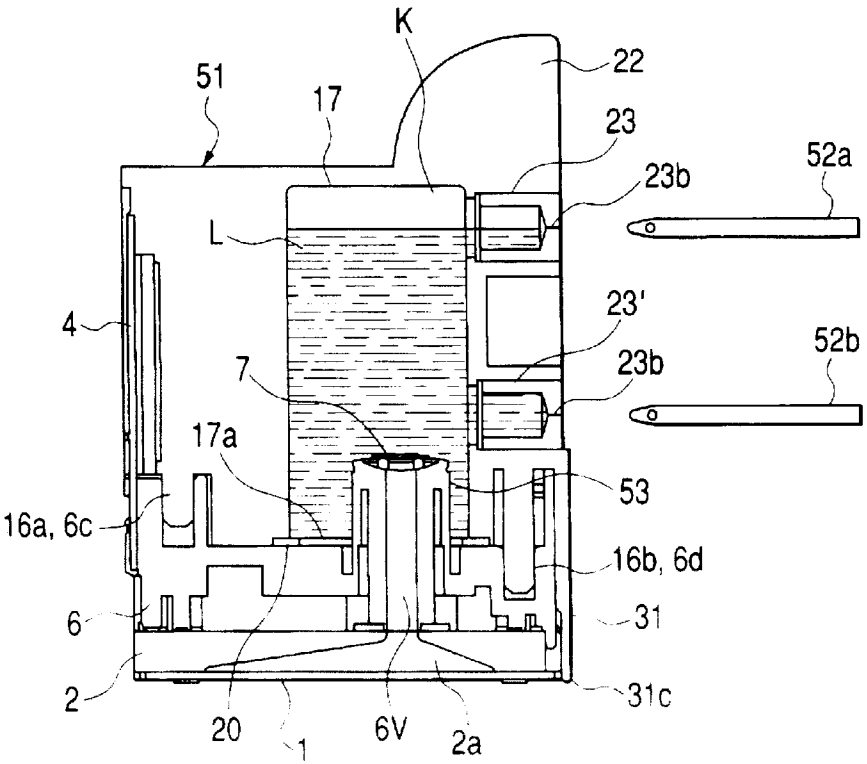
FIGS. 9A and 9B are side sectional views that schematically illustrate the arrangement of the porous member and needles, and the flow of recording liquid being supplied as well, for the liquid discharge head in accordance with the present invention.
Figure 9A:
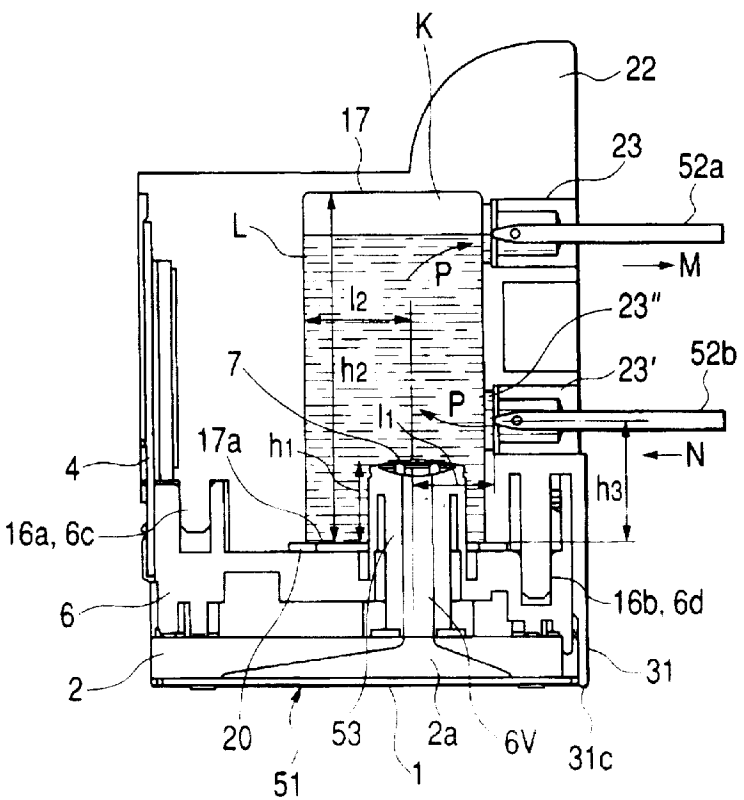
Figure 10:
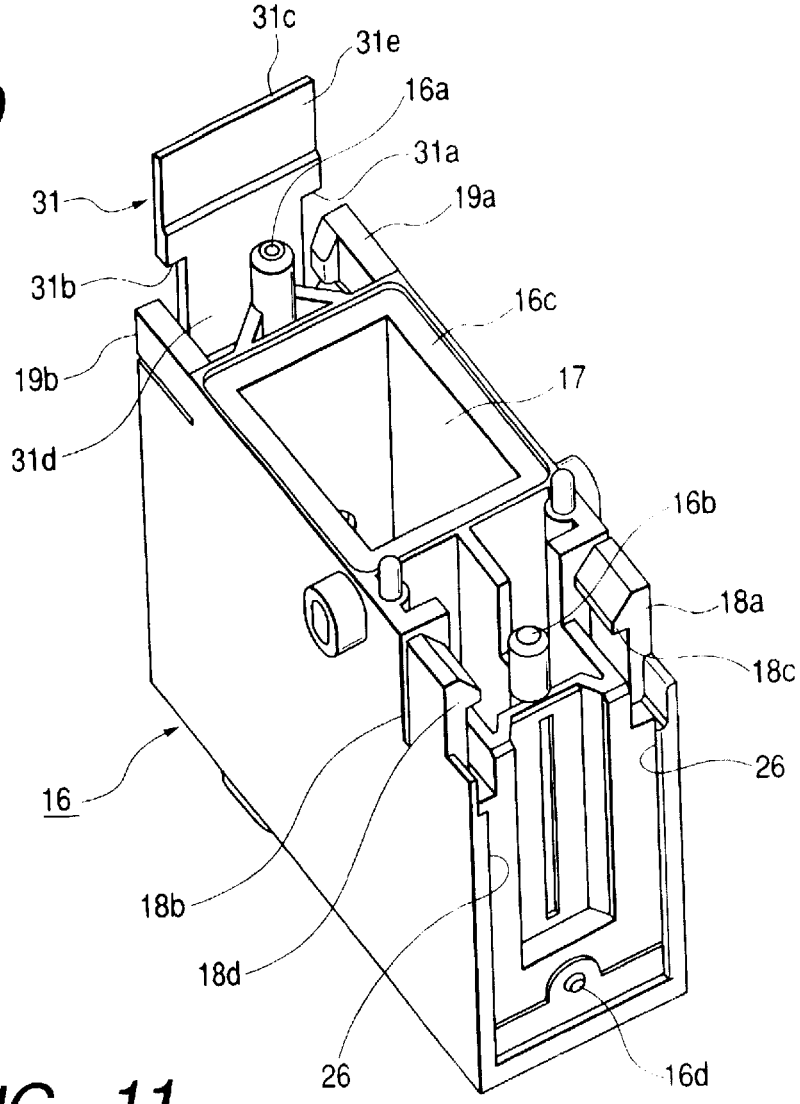
FIG. 10 is a perspective view that shows a frame member from below.
Figure 11:
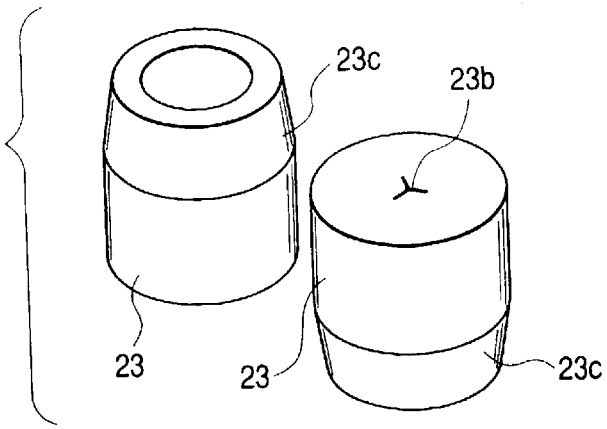
FIG. 11 is a perspective view that shows the outer appearance of a joint rubber.
Figure 12:
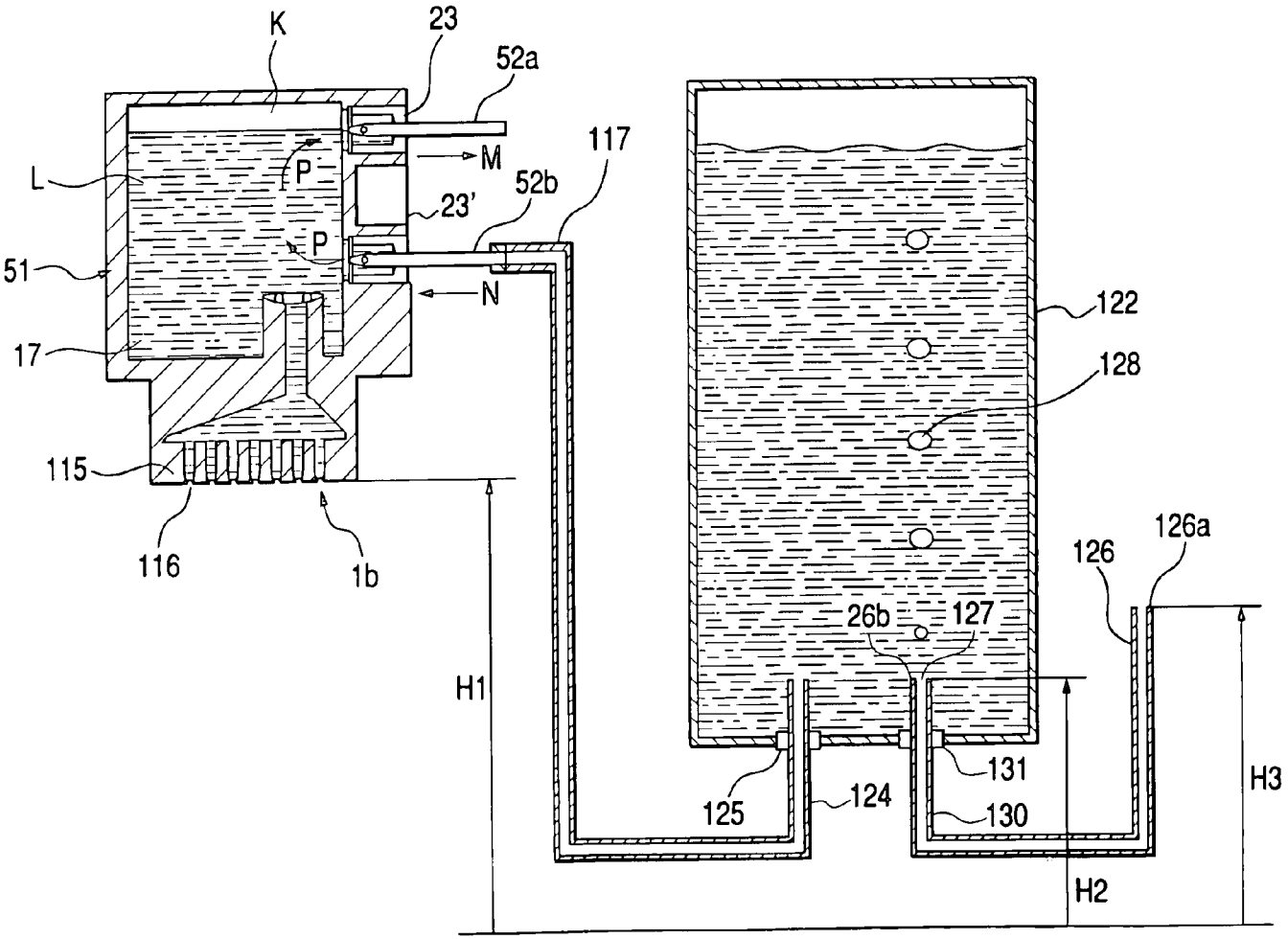
FIG. 12 is a view that schematically shows the supply passage of recording liquid for the liquid jet recording apparatus in accordance with the present invention.
Figure 13:
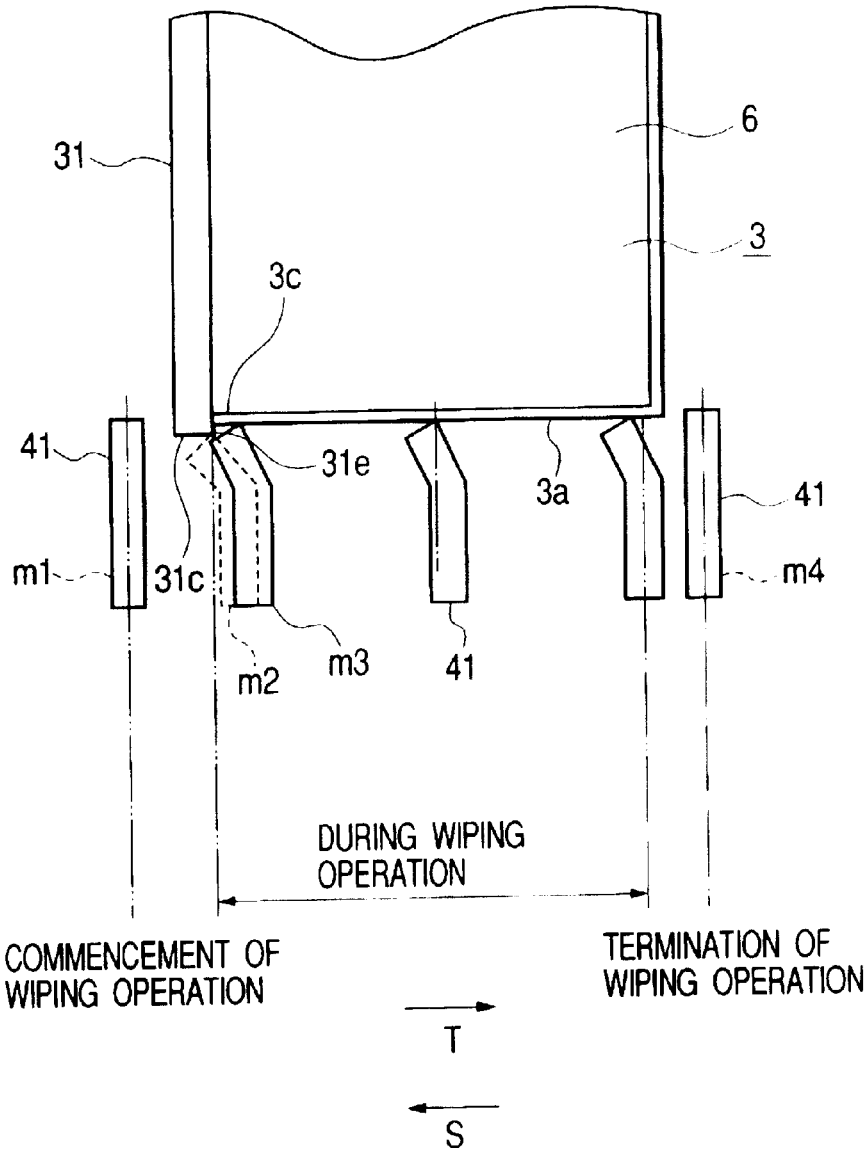
FIG. 13 is a view that schematically illustrates the wiping operation of a blade.
Figure 14:
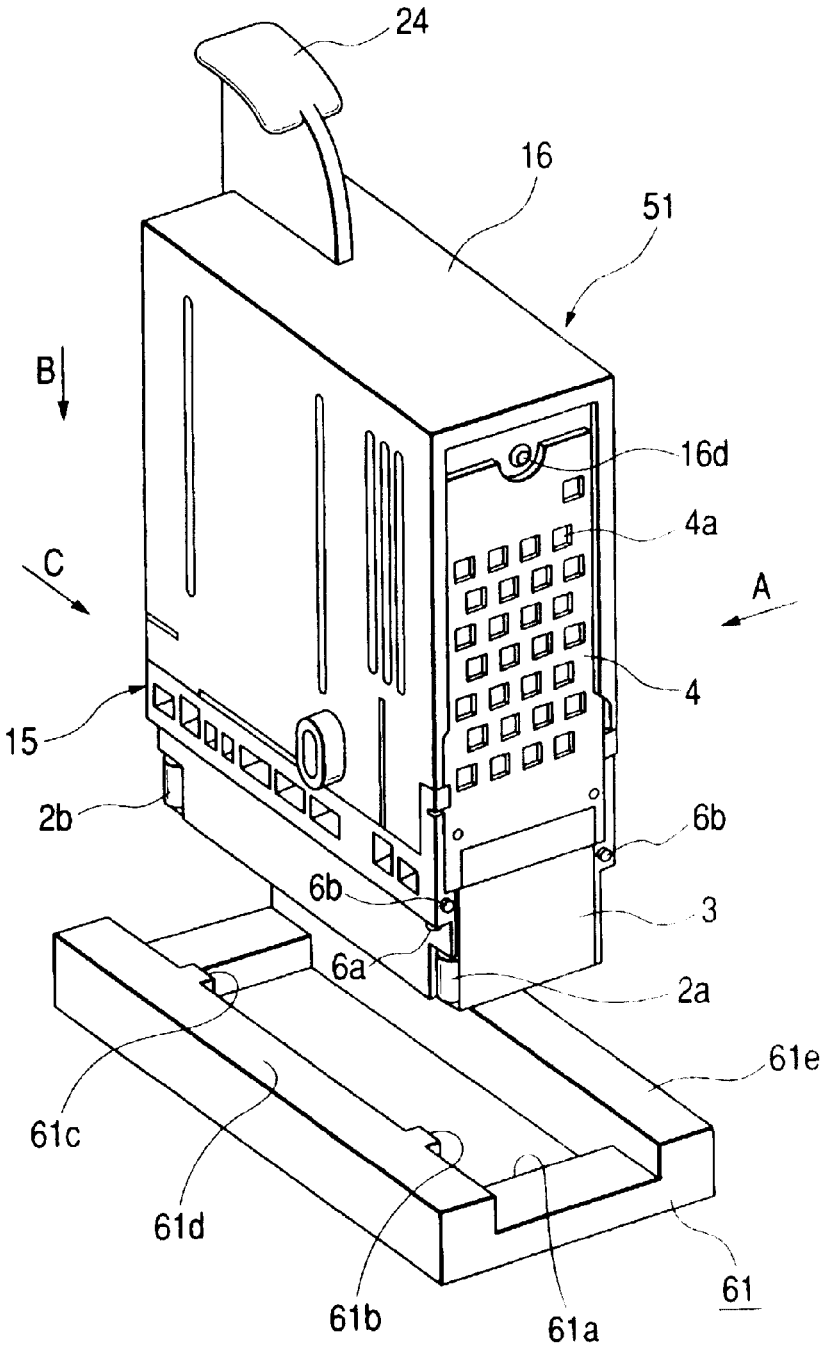
FIG. 14 is a perspective view that shows the outer appearance of the liquid jet recording head of the present invention before it is mounted on a carriage.
Figure 15:
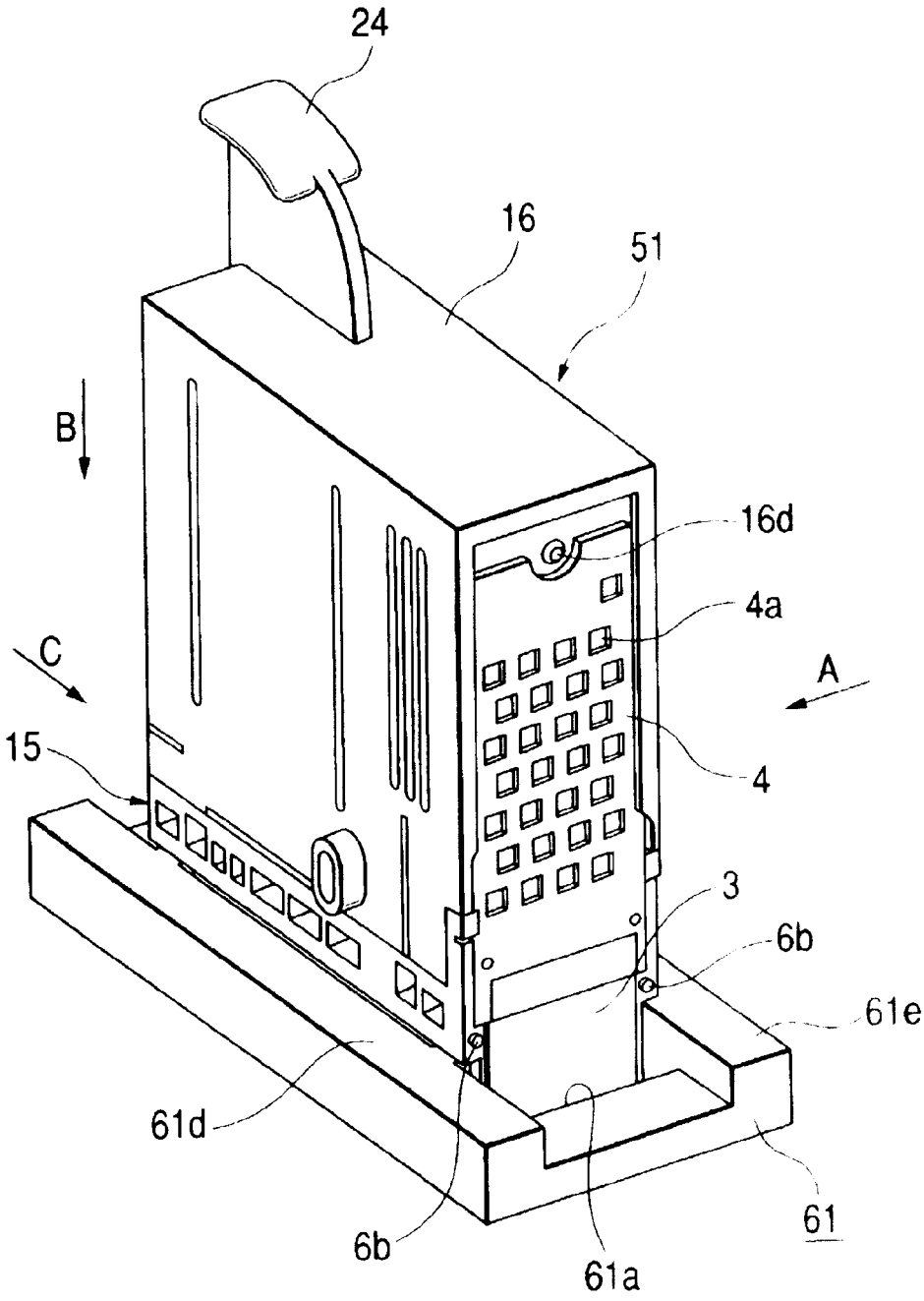
FIG. 15 is a perspective view that shows the outer appearance of the liquid jet recording head of the present invention after it is mounted on the carriage.

FIG. 1 and FIG. 2 are perspective views that illustrate the outer appearance of the liquid jet recording head embodying the present invention. FIG. 3 is an exploded perspective view that shows the liquid jet recording head. FIGS. 4A and 4B are exploded perspective views that illustrate the recording unit of the liquid jet recording head; FIG. 4A is an upper perspective view; and FIG. 4B is a lower perspective view. FIG. 5 and FIG. 6 are partial perspective views that illustrate the conjunction of the recording element base plate and the first plate; FIG. 5 is a perspective view that shows the state of conjugation; and FIG. 6 is a perspective view that shows the dismantled condition thereof. FIG. 7 is a lower perspective view that shows the outer appearance of the recording unit of the liquid jet recording head. FIG. 8 is a side sectional view that shows the sectional configuration of the porous member. FIGS. 9A and 9B are side sectional views that schematically illustrate the arrangement of the porous member and needles, and the flow of recording liquid being supplied; FIG. 9A shows the state where needles are inserted into the joint rubbers; FIG. 9B shows the state where needles are not inserted. Also, FIG. 10 is a perspective that shows the frame member from below. FIG. 11 is a perspective view that shows the outer appearance of the joint rubber. FIG. 12 is a view that schematically shows the supply passage of recording liquid for the liquid jet recording apparatus. Also, FIG. 13 is a perspective view that illustrates the wiping operation of the blade. FIG. 14 is a view that shows the liquid jet recording head before being mounted on the carriage. FIG. 15 is a view that shows it after being mounted on the carriage.

Hereinafter, with reference to the accompanying drawings, the description will be made of the liquid jet recording head embodying the present invention.

As shown in FIG. 1, FIG. 2, and FIG. 3, the liquid jet recording head 51 of the present embodiment is provided with a recording unit 15 that records information on a recording medium by discharging recording liquid, and a frame member 16 that holds the recording unit 15, while containing recording liquid to be supplied to the recording unit 15.

Although described later in detail, the recording unit 15 is provided, roughly, with a liquid droplet discharge portion that discharges liquid droplets from a nozzle array having discharge ports (nozzles) arranged in line in order to discharge liquid droplets in accordance with recording signals; and a wiring sheet, such as a flexible sheet, TAB, which forms electric wiring to receive and transmit the recording signals transmitted between the liquid droplet discharge portion and a driving control unit (not shown) provided for the recording apparatus. Roughly, the frame member 16 is structured to function as a recording liquid storing unit, which is provided with a recording liquid storing chamber (common liquid chamber) that contains recording liquid or the like to be supplied to the recording unit 15, and to function as a housing to hold the recording unit 15. Then, the liquid jet recording head 51 is of the so-called cartridge type in which it is detachably mountable on the carriage provided for the recording apparatus.

At first, with reference to FIG. 1 to FIG. 6, the description will be made of the structure of the recording unit 15 in accordance with one example.

As shown in FIG. 1 to FIG. 6, the recording unit 15 comprises a recording element base plate 1 for discharging recording liquid; a first plate 2 serving as the supporting base plate that supports the recording element base plate 1; a sheet wiring base plate 3 for transmitting recording signals to the recording element base plate 1; a contact terminal wiring base plate 4 with which one end of the sheet wiring base plate 3 is electrically connected to supply the recording signals; a second plate 5; a flow path formation member 6 provided with a recording liquid supply passage to supply recording liquid to the recording element base plate 1; and a porous member 7 for removing dust particles in the recording liquid.

For the recording element base plate 1, there are formed, by a film formation process, plural recording elements on one side of an Si substrate for discharging recording liquid, and wiring, such as Al, for supplying electric power to each recording element; by a photolithographic process, plural recording liquid flow paths and plural discharge ports (not shown) corresponding to the recording elements, respectively; and also, together therewith, the recording liquid supply port 1*a*, which is open to the backside thereof, for supplying recording liquid to the plural recording liquid flow paths communicated with discharge ports.

As shown in FIG. 3, FIG. 5, and FIG. 6, for the first plate 2, cylindrical surface portions 2*a* and 2*b* are provided on the two ends, respectively, on the side face in the longer side direction. Also, for the first plate 2, a cylindrical groove 2*c* is provided in the center of the side face in the shorter side direction. Then, with the plate that connects the vertices of the cylindrical surface portions 2*a* and 2*b* at two locations (hereinafter, referred to as a first reference plane), and the cylindrical groove 2*c* as a reference, the relative positions and inclination of the recording-element arrangement surface of the recording element base plate 1 are adjusted, respectively, and after that, the recording element base plate 1 is mounted on the main surface of the first plate 2 for bonding. In this manner, the relative positions of the recording element base plate 1 and the first plate 2 are set in high precision by use of the semiconductor assembling technique. Therefore, assembly is possible with a small amount of inclination from the recording element base plate 1 to the recording-element arrangement surface.

Also, since the first plate 2 is a plate member, it is made possible to carry out manufacturing highly precisely with respect to the plane geometrical precision on the assembling surface of the recording element base plate 1 and the opposite surface thereof, and the parallelism between the assembling surface of the recording base plate 1 and the opposite surface thereof as well. Consequently, although not shown, the joining device (not shown) of the recording element base plate is arranged with a simple structure of base stand for mounting the first plate 2, and the first plate 2 can be mounted on the base stand in high precision. In this way, the adjustment precision of the recording element base plate 1 is more enhanced with respect to the first plate 2, hence making the precision of the relative inclinations of the first reference plane of the first plate 2 and the recording element base plate 1 better, enhancing the productivity of the liquid discharge head.

Also, the first reference plane on the side face of the first plate 2 is in parallel to the side face of the recording element base plate 1 in the longer side direction. Therefore, as compared with the case where these faces are arranged to be orthogonal, the work observation area of the recording element base plate is made narrower on the device for joining. As a result, the adjustment work on the first plate 2 and the recording element base plate 1 is made easier so as to shorten the time of the operation. Furthermore, the mounting space for the work is made smaller, hence leading to the low-cost manufacture of the device for joining.

Further, the distance between the vertices of the cylindrical surface portions 2*a* and 2*b* of the first plate 2 is set larger than the length of the arrangement of the recording elements of the recording element base plate 1. Therefore, it is made easier to adjust the inclination of the recording element base plate 1 to the first reference plane by use of the first plate 2 when an adjustment operation is carried out, thus enhancing the adjustment precision for a stable production.

Also, as shown in FIG. 3 and FIG. 6, there is formed the recording supply passage 2*d* for the first plate 2 in order to supply recording liquid to the recording element base plate 1.

Also, to the first plate 2, a second plate 5 is bonded and fixed. On the center of the main surface of the second plate 5, an opening portion 5*a* is arranged to avoid interference when the recording element base plate 1 is assembled.

On the other hand, one end of the sheet wiring base plate 3 is bonded to the main surface of the second plate 5 to hold it, and then, electrically connected with the recording element base plate 1.

Further, the one end of the sheet wiring base plate 3 and the contact terminal wiring base plate 4 are electrically connected by use of an ACF (anisotropic conduction film), lead bonding, wire bonding, a connector, or other connecting means, for example.

Here, in accordance with the present embodiment, the structure is arranged to make the sheet wiring base plate 3 and the contact terminal wiring base plate 4 separate members as electric wiring means for supplying recording signals to the recording element base plate 1. However, the structure may be arranged so that the sheet wiring base plate 3 and the contact terminal wiring base plate 4 are formed integrally as one and the same member.

The aforesaid electric wiring means is a series of wiring portions in which the sheet wiring base plate 3 and the contact terminal wiring base plate 4 are electrically connected for use in applying electric signals to the recording element base plate 1 in order to discharge recording liquid. Then, there are formed the electric wiring corresponding to the recording element base plate 1, and the external signal input terminals 4*a* through which electric signals are received from the liquid jet recording apparatus main body. The contact terminal wiring base plate 4 having thess external signal input terminals 4*a* arranged therefor is positioned and fixed to one side face of the flow path formation member 6.

Also, as shown in FIG. 4A and FIG. 4B, the first plate 2 is bonded and fixed to the flow path formation member 6 by use of a bonding agent, screws, or some other bonding means. The first plate 2 and the flow path formation member 6 are bonded to each other, thus enabling the recording liquid passage on the first plate 2 side and the recording liquid passage on the flow path formation member 6 side to communicate with each other.

Also, the flow path formation member 6 is provided with spherical bosses 6*a* and 6*b* protrusively to position the liquid jet recording head 51 to the carriage to be described later. With the spherical boss 6*a*, the liquid jet recording head 51 is positioned in the direction indicated by an arrow B in FIG. 4A, and by the spherical boss 6*b*, it is positioned in the direction indicated by an arrow C in FIG. 4A.

Further, as shown in FIG. 8, a porous member 7 is bonded to the flow path formation member 6, and the porous member 7 is bonded by welding, bonding, or other means to the leading end of the cylindrical holder 53 arranged on the side opposite to the bonding portion of the first plate 2. Also, for the cylindrical holder 53, plural receiving pins 53*a* are arranged on the same circumference at equal angular intervals to support the porous member 7. Thus, the surface of the porous member 7 is corrected to be a spherically extruded form in the flow-in direction of liquid, and further, it is made possible to maintain the spherically extruded form even if an external load is received or the inner pressure of the common liquid chamber 17 (see FIGS. 9A and 9B) changes. As described earlier, the porous member 7 is arranged for the purpose of trapping particles, such as colorant or dust particles that have settled from the components of the recording liquid, which adhere to the liquid jet recording head structural members or an external storing chamber of recording liquid (not shown). Thereby, the porous member 7 prevents the recording liquid flow path on the downstream side of the porous member 7 from being clogged or stained.

Also, for the flow path formation member 6, there are provided fitting extrusions 9*a* and 9*b*, each of which is cut to be formed to engage with the frame member 16, and positioned on either side of the upper face 6*k* in the longer side direction on the side opposite to the side where the first plate 2 is bonded. Also, for the flow path formation member 6, a positioning hole 6*c* is provided in the vicinity of the fitting extrusion 9*b* for positioning it to the frame member 16. Further, for the fitting extrusion 9*a*, a positioning hole 6*d* is provided on the upper end face opposite to the frame member 16 for positioning it to the frame member 16.

Further, on both ends of the fitting extrusion 9*a* of the flow path formation member 6, there are arranged first receiving portions 6*h* and 6*g*, each of which is cut to be formed to engage with the frame member 16. Also, on both ends of the fitting extrusion 9*b* of the flow path formation member 6, there are provided the second receiving portions 6*e* and 6*f*, each of which is cut to be formed to engage with the frame member 16.

Next, with reference to FIGS. 9A and 9B, and FIG. 10, the description will be made of one example of the frame member 16.

As shown in FIGS. 9A and 9B, and FIG. 10, the frame member 16 is formed of a resin material, for example, and functions as a housing of the liquid jet recording head 51. Inside the frame member 16, the common liquid chamber 17 is arranged to contain recording liquid in a desired amount and retain the recording liquid L thus contained provisionally or until the complete consumption thereof.

Also, for the frame member 16, there are integrally formed bosses 16*a* and 16*b* on the side facing the flow path formation member 6, respectively, which are inserted into the positioning holes 6*c* and 6*d* of the flow path formation member 6.

Also, for the frame member 16, first snap fittings 18*a* and 18*b*, and second snap fittings 19*a* and 19*b* are formed to be elastically displaceable on one end facing the flow path formation member 6, which engage relatively with the fitting extrusions 9*a* and 9*b* of the flow path formation member 6.

Also, as shown in FIG. 1 and FIG. 10, an elongated piece 31 is provided for the frame member 16 to engage with the fitting extrusion 9*b* of the flow path formation member 6, which is integrally formed to be elongated toward the recording unit 15 side on the position on the recording unit 15 side corresponding to the one side face of the first plate 2 in the shorter side direction. The elongated piece 31 extends to the position that covers the end portion 3*c* of the sheet wiring base plate 3 of the recording unit 15, and the leading end 31*c* is slightly protruded from the face plane 3*a* of the recording unit 15 in the direction substantially orthogonal to the face plane 3*a*.

Also, the elongated piece 31 is a flat plate almost in the shape of a letter T, and provided with the elastically displaceable portion 31*d* on the base end side, which is made elastically displaceable in the thickness-wise direction. Further, for the elongated piece 31, there are formed on both ends of the first plate 2 in the shorter side direction, which are parallel in the widthwise direction, the hooks 31*a* and 31*b*, each of which is cut to be formed to engage with the fitting extrusion 9*b* of the flow path formation member 6. Also, for the fitting extrusion 9*b* of the flow path formation member 6, the fitting recess 33 is arranged to engage with the elongated piece 31 on the side end facing the outside. On the sidewall of the fitting recess 33, there are formed the third receiving portions 6*m* and 6*n*, with which the hooks 31*a* and 31*b* of the elongated pieces 31 are arranged to engage, respectively.

Further, for the frame member 16, the handle 24, which is integrally formed to hold the liquid jet recording head 51, is provided on the outer circumference on the side opposite to the side where the recording unit 15 is arranged.

Then, when the bosses 16*a* and 16*b* of the frame member 16 are inserted into the position holes 6*c* and 6*d* of the flow path formation member 6, the frame member is positioned on the flow path formation member 6. Thus, the first snap fittings 18*a* and 18*b* and the second snap fittings 19*a* and 19*b* of the frame member 16 engage with the first receiving portions 6*g* and 6*h* and the second receiving portions 6*e* and 6*f* of the fitting extrusions 9*a* and 9*b* of the flow path formation member 6, and likewise, the elongated piece 31 of the frame member 16 engages with the third receiving portions 6*m* and 6*n*. In this manner, the frame member 16 is completely bonded and fixed to the flow path formation member 6.

As described above, the hooks 31*a* and 31*b* are provided for the elongated piece 31 to arrange the structure so that the hooks engage with the third receiving portions 6*m* and 6*n* of the flow path formation member 6. Therefore, even if external force is exerted on the elongated piece 31 in the direction to push it to be away from the sheet wiring base plate 3, the elastically displaceable portion 31*d* of the elongated piece 31 is able to prevent the occurrence of bending displacement in the direction to release such engagement, by means of the frictional resistance resulting from the condition of the engagement between the hooks 31*a* and 31*b*, and the third receiving portions 6*m* and 6*n*.

Consequently, with the arrangement of the elongated piece 31 for the frame member 16, the length of the elastically displaceable portion 31*d* of the elongated piece 31 is made larger, and the bending rigidity of the elastically displaceable portion 31*d*. However, the structure is such that even if the thickness of the elastically displaceable portion 31*d* is made smaller, the portions in engagement are not easily released, thus making it possible to attempt downsizing of the liquid discharge head as a whole.

In this respect, the inner wall face 31*e* (see FIG. 10) of the elongated piece 31 is arranged in the vicinity of the end portion 3*c* (see FIGS. 4A and 4B) of the sheet wiring base plate 3 in the state that the frame member 16 and the flow path formation member 6 are bonded. On the other hand, the leading end portion 31*c* of the elongated piece 31 is arranged to protrude slightly from the face plane 3*a* of the sheet wiring base plate 3 in the recording liquid discharge direction.

Now, if the elongated piece 31 is provided on the side where the flow path formation member 6 is arranged, the elongated piece 31 becomes an obstacle when the sheet wiring base plate 3 is pushed to the flow path formation member 6 side in the bonding process of the sheet wiring base plate 3. In this case, therefore, it is necessary eventually to bond the sheet wiring base plate 3 onto the second plate 5 before bonding the flow path formation member 6. Thus, the structure in which the elongated piece 31 is provided on the side where the flow path formation member 6 is arranged affects the freedom of process setting to deteriorate productivity undesirably.

Furthermore, the leading end portion 31*c* of the elongated piece 31 protrudes from the face plane 3*a*. For example, therefore, if a recording sheet that has a large curl should pass or if a paper jam occurs in the recording apparatus, among some other events, the leading end portion 31*c* of the elongated piece 31 abuts against the recording sheet when the recording sheet would otherwise be in contact with the discharge ports. In this manner, contact between a recording sheet and the discharge ports can be prevented. Thus, with the elongated piece 31, it is possible to prevent a recording sheet from damaging the circumference of the discharge ports and the face plane 3*a*, and also, to avoid the occurrence of any drawback that may degrade the quality of images recorded on the recording sheet.

The rail type groove 26 (see FIG. 10), which is formed for the frame member 16, holds the contact terminal wiring base plate 4 exactly when the frame member 16 and the flow path formation member 6 are bonded. Here, the leading end portion 4*d* of the contact terminal wiring base plate 4 enters the rail type groove 26 to be fitted into the pre-determined position. In other words, the lower end portion 4*e* of the contact terminal wiring base plate 4 is held by the flow path formation member 6, and the the leading end portion 4*d* of the contact terminal wiring base plate 4 is held by the rail type groove 26 of the frame member 16.

As described above, unlike the structure in which the contact terminal wiring base plate 4 is fixed to the flow path formation member 6 by tightening with pressurized heating, there is no need for the provision of any holes on the contact terminal wiring base plate 4 for use of tightening with pressurized heating, which makes it possible to make the width of the contact terminal wiring base plate 4 smaller. Thus, the entire width of the liquid discharge head can be made more compact.

Also, the structure is such that when the flow path formation member 6 is assembled with the frame member 16, the leading end portion 4*d* of the contact terminal wiring base plate 4 is inserted into the rail type groove 26. This makes it possible to limit the steps of the production process needed for fixing the contact terminal wiring base plate 4, thus enhancing productivity. Moreover, the contact terminal wiring base plate 4 can be removed easily to make the dismantling operation of the liquid jet recording head 51 easier. Therefore, this structure is excellent, too, in terms of the recycling capability.

Also, the contact terminal wiring base plate 4 is held in such a manner that the flow path formation member 6 and the frame member 16 are separated. As a result, unlike the conventional structure, there is no need for the provision of any space that may enable the flow path formation member 6 to receive the entire area of the contact terminal wiring base plate 4. The flow path formation member 6 can be formed efficiently to make it more compact accordingly.

Also, the liquid jet recording head 51 is provided with a sealing member 20 to airtightly close the connecting part of the recording flow passage between the frame member 16 and the flow path formation member 6. The sealing member 20 is formed of rubber, elastomer, or other elastic material in the form of a frame, for example, and as shown in FIG. 4A and FIG. 4B, the upper rib 21 and lower rib 22 are integrally formed to be extruded along the outer circumference on the upper face opposite to the frame member 16, and the lower face opposite to the flow path formation member 6, respectively.

Also, for the sealing member 20, a positioning boss 20*a*, which engages with the upper face 6*k* to be positioned, is arranged for each of the corner portions on the lower face opposite to the upper face 6*k* of the flow path formation member 6, respectively. Also, on the upper face 6*k* of the flow path formation member 6, positioning holes 6*j*, with which the positioning boss 20*a* of the sealing member 20 engage, respectively, are arranged along the outer circumference of the porous member 7.

Then, after the positioning bosses 20*a* are inserted into the positioning holes 6*j*, respectively, of the flow path formation member 6, the frame member 16 and the flow path formation member 6 are assembled. Then, the sealing member 20 closes the inside of the common liquid chamber 17 completely, because the upper rib 21 on the upper face side and the lower rib 22 on the lower face side are compressed by the nipping pressure exerted by the lower face 16*c* (see FIG. 10) of the frame member 16 and the upper face 6*k* of the flow path formation member 6.

As described above, when the frame member 16 and the flow path formation member 6 are connected, the porous member 7 enters the common liquid chamber 17. As a result, recording liquid L in the common liquid chamber is supplied from the porous member 7 to the nozzle portion of the recording element base plate 1 through the recording liquid supply port 1*a* of the recording element base plate 1 by way of the flow path 6*v* (see FIGS. 8, 9A and 9B) of the flow path formation member 6 and the recording liquid supply path 2*d* of the first plate 2.

In this respect, the porous member 7 is installed at a position higher than the bottom face 17*a* of the common liquid chamber 17 (see FIGS. 9A and 9B).

Also, the handle 24 provided for the ceiling face of the frame member 16 functions as the handhold when the liquid jet recording head 51 is attached to or detached from the carriage 61 (see FIGS. 14 and 15) provided for the recording apparatus.

Further, for the frame member 16, there are provided an upper joint rubber 23 serving as the exhaust portion for exhausting the air K inside the common liquid chamber 17, and a lower joint rubber 23' serving as the supply portion for recording liquid in order to supply recording liquid to the common liquid chamber 17. As shown in FIG. 11 (the upper joint rubber 23 and the lower joint rubber 23' having the same structure, FIG. 11 shows only the upper joint rubber 23), on the center of the end face of the upper joint rubber 23 and that of the lower joint rubber 23', a cracked hole 23*b* is arranged in a Y-shaped slit, respectively. Then, each of the joint rubbers 23 and 23' is pressed into a cylindrical hole 16*d* of the frame member 16, the inner dimension of which is made smaller than the outer dimension of each of the joint rubbers 23 and 23'. Also, each leading portion 23*c* of the joint rubbers 23 and 23', which is pressed into the frame member 16, is tapered with smaller diameters toward the leading end, thus securing an excellent capability of insertion into the cylindrical hole 16*d*.

As described above, with the cracked hole 23*b* formed for each of the joint rubbers 23 and 23', the leading ends of the needles 52*a* and 52*b* break the cracked holes 23*b* when the upper needle 52*a*, which exhausts the air K in the common liquid chamber 17 of the recording liquid supply mechanism (not shown) of the recording apparatus, and the lower needle 52*b* for supplying recording liquid are inserted into the joint rubbers 23 and 23', respectively, as shown in FIG. 9A, thus making the insertion into the common liquid chamber 17 of the frame member 16 smoothly. Also, as shown in FIG. 9B, the cracked holes 23*b* are closed by receiving a compression load from the outer circumference of the joint rubbers 23 and 23', respectively, when the needles 52*a* and 52*b* are not inserted. Therefore, the inside of the common liquid chamber 17 can be conditioned to be airtight. In this way, each of the joint rubbers 23 and 23' is made workable by switching, as appropriate, between a recording liquid supply condition in which recording liquid can be supplied from the outside to the common liquid chamber 17 and a non-supply condition in which there is no supply of recording liquid from the outside to the common liquid chamber 17.

The joint rubbers 23 and 23' are arranged at the upper and lower locations, respectively. The lower joint rubber 23' is the supply passage for supplying recording liquid L from the recording liquid storing tank 122 (see FIG. 12) arranged for the recording apparatus main body, and recording liquid L is supplied into the common liquid chamber 17 through the lower needle 52*b* in the direction indicated by the arrow N.

On the other hand, the upper joint rubber 23 is the air suction passage for negatively pressurizing the inside of the common liquid chamber 17, as described above, by releasing the air K accumulated inside the common liquid chamber 17 to the outside of the common liquid chamber 17. Therefore, with air suctioning means (not shown), such as a pump, the air K inside the common liquid chamber 17 is evacuated from the common liquid chamber 17 to the outside through the upper needle 52*a* in the direction indicated by the arrow M, thus controlling the negative pressure inside the common liquid chamber 17. In other words, by increasing the negative pressure inside the common liquid chamber 17, it is possible to control the replenishment of recoding liquid L in the common liquid chamber 17.

Further, the upper needle 52*a* and the lower needle 52*b* are made electrically conductive, and when the height of the liquid surface of recording liquid L in the common liquid chamber is raised to enable both the upper needle 52*a* and the lower needle 52*b* to be in contact with recording liquid L, the upper needle 52*a* and the lower needle 52*b* are electrically connected through recording liquid L. As a result, the full-tank condition of the liquid surface of recording liquid L can be detected.

As described above, in the mode of the liquid jet recording head in which recording liquid L is supplied from the recording storing tank 122 located away from the head, recording liquid L inside the common liquid chamber 17 flows in the direction from down to up as indicated by the arrows P in FIG. 9A and FIG. 12 when recording liquid is supplied.

Therefore, the recording liquid L already inside the common liquid chamber 17 is agitated by the flow P of recording liquid L, and thus the recording liquid L eventually flows even in the vicinity of the surface of the porous member 7.

As described earlier, the surface of the porous member 7 is in the spherically extruded form, which is made smoothly convex. This arrangement is made so as not to disturb the flow of recording liquid L, which is in contact with the surface of the porous member 7, and it is also made possible to enable the flow of recording liquid to be in contact with the entire area of the surface of the porous member 7.

Further, on the circumference of the porous member 7, the flow of recording liquid L is controlled to proceed as much as possible unhindered by resistance to the flow of recording liquid L. For this purpose, countermeasures are taken such as preparing the holder 53 for holding the porous member 7 in a cylindrical form, and arranging the porous member 7 to be higher than the bottom face 17*a* of the common liquid chamber 17 (at the height $h_1$ in FIG. 9A), among others.

As a result, when agitated, colorant, dust particles, and other matter accumulated on the surface of the porous member 7 are transferred, upon the flow of recording liquid L, to separate from the surface of the porous member 7, thus floating again in the recording liquid L or dropping off toward the bottom face 17*a* of the common liquid chamber 17. Thus, colorant and dust particles floating in the recording liquid L settle on the surface of the porous member 7 sooner or later or settle on the bottom face 17*a* of the common liquid chamber 17. Here, the amount of the particles dropping off the porous member 7 to the bottom face 17*a* becomes larger inevitably, because the bottom face 17*a* has a larger area.

At this time, however, it is anticipated that the particles that have settled on the surface of the porous member 7 are again transferred for removal when the next agitation takes place.

On the other hand, the particles that have dropped off to the bottom face 17*a* of the common liquid chamber 17 are caused to eventually remain on that surface even if agitation is repeatedly operated, because the bottom face 17*a* is away from the area in which flow is induced, and also because it is difficult for the particles to float again to join the flow of recording liquid, due to the existence of such obstacles as the cylindrical holder 53, and a larger resistance that acts on the flow of recording liquid L, which collides with the bottom face 17*a*.

As described above, with the agitation operated inside the common liquid chamber 17 when recording liquid L is supplied, recording liquid L flows smoothly in contact with the surface of the porous member 7, thus preventing colorant and dust particles that have stagnated on the surface of the porous member 7 to remain thereon.

In this respect, if the porous member 7 were formed with a flat face or in a recessed form, resistance would be generated when colorant and dust particles are transferred, and colorant and dust particles would not ride on the flow of recording liquid L at the time of agitation, thus impeding their separation from the surface of the porous member 7 at all.

Under the circumstances described above, it becomes an effective means for the active transfer of colorant and dust particles on the surface of the porous member 7 that the porous member 7 be provided in the area where recording liquid L flows with good force.

Now, in accordance with the present embodiment, the distance 11 from the center of the cylindrical holder 53 to the end portion 23" of the lower joint rubber 23' is made smaller than the distance 12 from the center of the cylindrical holder 53 to each surface opposite to the joint rubbers 23 and 23' in order to enable the flow of recording liquid supplied from the lower needle 52*b* to be efficiently in contact with the entire area of the surface of the porous member 7. In other words, the porous member 7 is arranged to be close to the lower joint rubber 23.

Also, in order to activate agitation, the bottom face 17*a* of the common liquid chamber 17 is made narrower, while the arrangement is made to enable the inner height $h_2$ of the common liquid chamber 17 to be greater. Further, as a method other than the one described in the present embodiment, it may be effective to make the height $h_1$ of the porous member 7 be equal to or greater then the height $h_3$ of the lower joint rubber 23.

Next, in conjunction with FIG. 12, which schematically shows the structural outline of the recording apparatus including the liquid supply device embodying the present invention, the detailed description will be made of the process of supplying liquid from the recording liquid storing tank to the common liquid chamber.

The recording liquid supply device is directed vertically downward, and is provided with the recording liquid storing tank 122 that contains recording liquid, the recording liquid supply tube 117 constituting a first pipe-type connector through which recording liquid is supplied from the recording liquid storing tank 122 to the liquid jet recording head 51, and the air releasing tube 126 serving as a second pipe-type connector through which the air is induced into the recording liquid storing tank 122.

The recording liquid storing tank 122 is a housing having high rigidity, which is formed of polyethylene, polypropylene, Noryl, or the like, in a thickness of 0.5 mm or more, for example, and made not to be easily deformable.

The recording liquid supply tube 117 contains the pipe-type needle portion 124, which is formed by stainless steel or the like. The needle portion 124 penetrates the rubber plug 125 covering the hole provided for the bottom face of the recording liquid storing tank 122, which can be inserted into the recording storing tank 122. Likewise, the air releasing tube 126 contains the pipe-type needle portion 130, which is formed by stainless steel or the like. The needle portion 130 penetrates the rubber plug 131 covering the hole provided for the bottom face of the recording liquid storing tank 122, which can be inserted into the recording storing tank 122.

Also, the recording liquid supply tube 117 is bent in the horizontal direction on the lower end of the needle portion 124 that stands vertically, and then, bent again upward to be communicated with the inside of the head from the side wall in the vicinity of the bottom face of the common liquid chamber 17 of the liquid jet recording head 51. On the other hand, the air releasing tube 126 is bent in the horizontal direction on the lower end of the needle portion 130 that stands vertically, and then, bent again upward.

The holes thus provided for the bottom face of the recording liquid storing tank 122 are released to serve as the injection inlet when recording liquid is injected into a recording liquid storing tank 122 yet to be used, and after the injection of recording liquid, the holes are plugged by rubber plugs 125 and 131, respectively. As shown in FIG. 12, when installed on the recording apparatus main body, the needle portions 124 and 130 penetrate the rubber plugs 125 and 131, respectively, thus being inserted into the recording liquid storing tank 122. Then, the recording liquid storing tank 122 and the liquid jet recording head 51 are communicated through the recording liquid supply tube 117 that contains the needle portion 124 (the first connector), while the air inside the recording liquid storing tank 122 is released through the air releasing tube 126 that contains the needle portion 130 (the second connector). Before the recording liquid storing tank 122 is installed on the recording apparatus main body, or after it is removed from the recording apparatus main body, the rubber plugs 125 and 131 plug the holes. Thus, there is no possibility that recording liquid flows out from the recording liquid storing tank 122. At this juncture, even if the holes should be open by the needle portions 124 and 130, the holes close up by means of the elasticity of rubber plugs 125 and 131 at the same time that the needle 124 is withdrawn.

The liquid jet recording head 51 is installed on the recording apparatus main body with the recording liquid discharge port surface 1*b* of the recording element base plate 1 having the discharge ports formed therefor downward.

The inside of the recording liquid supply tube 117 that contains the needle 124 is filled with recording liquid over its entire length. The common liquid chamber 17 is not filled with recording liquid up to the full capacity thereof. There remains a portion where the air K is accumulated. Also, using a valve or the like (not shown) the needle 52*a* side is closed after it has been used for the suction of recording liquid to fill the inside of the liquid jet recording head 51. Therefore, recording liquid L is not allowed to leak.

For the nozzle 115 communicated with each discharge port, meniscus 116 of recording liquid is formed. With the surface tension of the meniscus 116, recording liquid is retained in the vicinity of the discharge port so as not to drop off.

According to the present invention, the recording liquid storing tank 122 may be filled with recording liquid up to its full capacity when its use begins, but as recording liquid is consumed, recording liquid is not necessarily filled up to its full capacity. In the tank, there remains a portion where the air is accumulated. Also, the leading end 126*b* of the air releasing tube 126 is positioned lower than the height of the discharge port of the liquid jet recording head 51, and the boundary face between recording liquid and the air (the air outside) exists in the air releasing tube 126. On this boundary face, meniscus 127 is formed. In this way, under conditions of normal use, constant negative pressure acts on the nozzle 115 communicated with the discharge port of the liquid jet recording head 51 by the surface tension exerted by the meniscus 127 in the air releasing tube 126, thus preventing the leakage of recording liquid from the nozzle 115. At this juncture, the size of the inner diameter of the air releasing tube 126 becomes important, with respect to forming the meniscus for the generation of negative pressure. Here, the inner diameter of the air releasing tube 126 is approximately 0.1 mm to 10 mm, more preferably, approximately 0.1 mm to 2.0 mm.

In the recording apparatus structured as described above, when the inner temperature of the liquid jet recording head 51 rises as the recording operation proceeds, or the like, the air K expands in the common liquid chamber 17, increasing the inner pressure of the common liquid chamber 17. Therefore, recording liquid L in the common liquid chamber 17 reversibly flows to the recording liquid storing tank 122 through the recording liquid supply tube 117. In this way, the pressure increase in the common liquid chamber 17 is eliminated. The reversibly flown recording liquid is contained in the recording liquid storing tank 122. At this time, the inner pressure of the recording liquid storing tank 122 rises, increasing the pressure on the recording liquid in the recording liquid storing tank 122, thus causing the recording liquid in the recording liquid storing tank 122 to enter the air releasing tube 126 deeply. In other words, the position of the meniscus 127 of the recording liquid is lowered. When the pressure rise is great, the air releasing tube 126 is bent so that the meniscus 127 of recording liquid moves to the intermediate portion that extends horizontally. If the pressure rise is extreme, it is conceivable that recording liquid may suddenly fly out of the releasing end 126*a*, which faces upward on account of the air releasing tube 126 being bent accordingly.

Also, when recording liquid is consumed in the liquid jet recording head 51 by the recording operation of the recording apparatus, the recording liquid L in the common liquid chamber 17 is reduced, thereby lowering the inner pressure of the common liquid chamber 17. Then, recording liquid in the recording liquid storing tank 122 flows into the common liquid chamber 17 through the recording liquid supply tube 117, thus eliminating the pressure reduction in the common liquid chamber 17. Along with this, since recording liquid has flown out of the recording liquid storing tank 122, the inner pressure of the recording liquid storing tank 122 is reduced. As a result, air is sucked through the air releasing tube 126, bringing in bubbles 128 in the recording liquid storing tank 122 in an amount compensating for the reduced amount of recording liquid. At this time, the meniscus 127 in the air releasing tube 126 is positioned at the leading end 126*b* of the air releasing tube 126 in the recording liquid storing tank 122. After that, when an appropriate amount of bubbles (the air) 128 have been brought in, the inside of the recording liquid storing tank 122 is restored to the predetermined pressure and becomes stabilized. Then, the induction of the air outside terminates.

As described above, the boundary face between the recording liquid and the air in the air releasing tube 126, that is, the meniscus 127, moves to absorb the pressure changes in the common liquid chamber 17, hence making it possible to keep the negatively pressurized condition of the recording liquid constant in the liquid jet recording head 51, and no change is given to the meniscus 116 in the nozzle 115 that prevents recording liquid from dropping out of the nozzle 115.

Also, in accordance with the present invention, the recording liquid supply device is arranged to absorb pressure changes by the movement of the meniscus 127 on the boundary surface between the recording liquid and the air in the air releasing tube 126 that releases the recording liquid storing tank 122 to the air outside. Thus, there is no need for the recording liquid storing tank 122 to be deformed, making it unnecessary to provide a space around the recording liquid storing tank 122. The generation of negative pressure needed for preventing the leakage of recording liquid from the nozzle 115 depends on the position of the discharge port at the top of the nozzle 115 of the liquid jet recording head 51 and the position of the leading end 126*b* of the air releasing tube 126. Thus, there is no restriction at all upon the size of the recording liquid storing tank 122. Particularly, the positional relation between the nozzle 115 of the liquid jet recording head 51 and the upper part of the recording liquid storing tank 122 is not constrained. Thus, for example, even if the upper part of the recording liquid storing tank 122 is located on the upper side of the nozzle 115 of the liquid jet recording head 51, there is no problem at all. The recording liquid storing tank 122 is a housing corresponding to the amount of recording liquid to be contained. It is possible to contain recording liquid up to its full capacity, thus making the efficiency of recording liquid storage extremely favorable.

As understandable from FIG. 12, the positional relation between the position (height H1) of the discharge port at the tip of the nozzle 115, the position (height H2) of the leading end 126*b* of the air releasing tube 126 where a meniscus is formed under normal conditions of use, and the position (height H3) of the releasing end 126*a* of the air releasing tube 126 are provided as given below so as to prevent the flowing out of recording liquid from the nozzle 115.

(1) At first, the positional relation between the discharge port of the nozzle 115 and the leading end 126*b* of the air releasing tube 126 of the recording liquid storing tank 122 is arranged to be H1>H2, as described above. In this positional relation, the liquid supply device of the present embodiment does not allow recording liquid to flow out from the nozzle 115 of the liquid jet recording head 51 under normal conditions of use, thus executing stable discharges with a constant pressure exerted on the nozzle 115.

(2) Next, the positional relation between the leading end 126*b* of the air releasing tube 126 of the recording liquid tank 122 and the releasing end 126*a* of the air releasing tube 126 is arranged to be H2<H3, as shown in FIG. 12.

When the recording operation of the recording head is at rest, the air accumulated in the recording liquid storing tank 122 expands if the outside temperature rises. Expansion of this kind should be eliminated either from the nozzle 115 in the liquid supply device or from the releasing end 126*a* of the air releasing tube 126.

However, with respect to the nozzle diameter of the nozzle 115 and the inner diameter (hole diameter) of the air releasing tube 126, it is arranged to make the inner diameter of the air releasing tube 126 larger. Therefore, the holding power made available by the meniscus formed therein is significantly larger than in the nozzle. As a result, the expansion of the air is eliminated by the movement of recording liquid to the releasing end 126*a* through the inside of the air releasing tube 126.

At this juncture, if the positional relation were arranged to be H2>H3, there is a fear that recording liquid in the liquid jet recording head 51 and the recording liquid storing tank 122 could flow out entirely from the hole at the releasing end 126*a* of the air releasing tube 126 if the meniscus 116 in the nozzle 115 should be broken by some unexpected outer disturbance, which allowed air to be induced from the nozzle 115. Therefore, in consideration of the possible occurrence of such event, it is desirable to arrange the positional relation to be H2<H3.

(3) Further, the positional relation between the discharge port of the nozzle 115 and the releasing end 126*a* of the air releasing tube 126 should desirably be H1>H3, because a problem is encountered if recording liquid flows out from the nozzle 115 in a condition where the outer temperature rises (in a state where recording liquid is filled up to near the releasing end 126*a* though the inside of the air releasing tube 126).

Next, the description will be made, further in detail, of the bonding condition of the flow path formation member 6 of the recording unit 15 and the frame member 16.

The boss 16*a* of the frame member 16 is inserted into the positioning hole 6*c* of the flow path formation member 6. The boss 16*b* of the frame member 16 is inserted into the positioning hole 6*d* of the flow path formation 6. The first snap fittings 18*a* and 18*b* of the frame member 16 engage with the second receiving portions 6*g* and 6*h* of the flow path formation member 6. The second snap fittings 19*a* and 19*b* of the frame member 16 engage with the second receiving portions 6*e* and 6*f* of the flow path formation member 6. The hooks 31*a* and 31*b* of the elongated piece 31 of the frame member 16 engage with the third receiving portions 6*m* and 6*n* of the flow path formation member 6. Further, the frame member 16 and the flow path formation member 6 nip the sealing member 20 between the opposite faces thereof. In this manner, the recording liquid flow paths of the frame member 16 and flow path formation member 6 are airtightly closed to enable them to be communicated with each other and fixed completely.

Therefore, as compared with the mode in which the recording unit 15 and the frame member 16 are bonded by screws, bonding agent, or the like or the mode in which bonding portions of both of them are airtightly closed through sealant or the like, the liquid jet recording head 51 of the present embodiment makes it easier to assemble the recording unit 15 and the frame member 16, with a structure suitable for recycling, hence making the manufacture of the liquid jet recording head 51 possible at lower costs.

Also, the first snap fittings 18*a* and 18*b*, and the second snap fittings 19*a* and 19*b* are each provided with a pair of fitting nails that face each other in the positions facing the first receiving portions 6*g* and 6*h*, or facing the second receiving portions 6*e* and 6*f*, as the case may be, in the direction of being hooked. Therefore, the snap fittings and the receiving portions are held together strongly.

Further, the elastically displaceable portions of the first snap fittings 18*a* and 18*b* in the longitudinal direction are formed in agreement with the bonding direction in which the frame member 16 and the flow path formation member 6 are bonded. Also, the elastically displaceable portions of the second snap fittings 19*a* and 19*b* in the longitudinal direction are formed in the direction substantially orthogonal to the bonding direction in which the frame member 16 and the flow path formation member 6 are bonded. In other words, the elastically displaceable portions of the first snap fittings 18*a* and 18*b* and second snap fittings 19*a* and 19*b* are formed in elastically displaceable directions orthogonal to each other when the frame member 16 and the flow path formation member 6 are bonded.

In this way, the tensile stress acts in the longitudinal direction of the elastically displaceable portions of the first snap fittings 18*a* and 18*b* if any shock is given in the direction (indicated by the arrow a in FIG. 1) in which the bonding condition of the frame member 16 and the flow path formation member 6 is released due to unexpected dropping of the liquid jet recording head 51 or the like. However, the rigidity provided for the first snap fittings 18*a* and 18*b* is sufficient to withstand such tensile stress, so there is no possibility that the bonding condition between the first snap fittings 18*a* and 18*b* and the first receiving portions 6*g* and 6*h* is released due to the load of shocks that may act in this direction.

Also, the frame member 16 and the flow path formation member 6 are bonded with the sealing member 20, which is nipped under compression, and the repulsion of the sealing member 20 always acts in the direction in which the frame member 16 and the flow path formation member 6 separate from each other. The elastically displaceable portions of the first snap fittings 18*a* and 18*b* are provided with the tensile strength that sufficiently withstands such repulsion of the sealing member 20. Also, likewise, the elastically displaceable portion 31*d* of the elongated piece 31 is provided with the tensile strength that can withstand the repulsion of the sealing member 20.

Further, the hook faces of the first snap fittings 18*a* and 18*b*, and the first receiving portions 6*g* and 6*h* are in contact substantially horizontally (in parallel) for the engagement thereof. Therefore, the frame member 16 and the flow path formation member 6 are bonded with highly precise positioning effectuated by the connection of these two members.

On the other hand, at the location where the second snap fittings 19*a* and 19*b* and the second receiving portions 6*e* and 6*f* engage with each other, bending stress acts on the elastically displaceable portions of the second snap fittings 19*a* and 19*b* if any shocks are received in the direction in which the bonding of the frame member 16 and the flow path formation member 6 is released. Here, the rigidity of the second snap fittings 19*a* and 19*b* is comparatively small against such bending stress. Therefore, although there is no possibility that the bonding condition of the second snap fittings is released, bending deformation occurs eventually if a large load is received.

Moreover, as described above, the repulsion of the sealing member 20 always acts on the connecting portion of the frame member 16 and the flow path formation member 6. There is a fear that displacement may take place due to such bending deformation, which causes the frame member 16 and the flow path formation member 6 to move in the direction in which these members are separated. This eventually leads to the deterioration of positioning precision for the frame member 16 and the flow path formation member 6.

In other words, against such repulsion brought about by the sealing member 20 of the kind, it is made possible for the first snap fittings 18*a* and 18*b* and the elongated piece 31 to secure a larger resistance to the load than that of the second snap fittings 19*a* and 19*b*. Therefore, against the repulsive load of the sealing member 20, support is mainly provided eventually by the hooking portions 18*c* and 18*d* of the first snap fittings 18*a* and 18*b*, and the hooks 31*a* and 31*b* of the elongated piece 31.

Thus, the elongated piece 31, which is positioned and arranged near the second snap fittings 19*a* and 19*b* reinforces the bonding strength of the second snap fittings 19*a* and 19*b* in the direction in which the recording unit 15 and the frame member 16 are separated.

Next, the description will be made of the case where shocks are received in the hook displacement direction (indicated by an arrow β in FIG. 1) of the first snap fittings 18*a* and 18*b* and the second snap fittings 19*a* and 19*b*, that is, the direction in which the snap fittings are opened and closed.

When shocks are given in this direction, bending stress acts on the elastically displaceable portions of the first snap fittings 18*a* and 18*b*, and the first snap fittings 18*a* and 18*b* exhibit bending deformation with ease. Then, if the hooking portions 18*c* and 18*d* of the first snap fittings 18*a* and 18*b* should be dislocated, the hook faces of the first snap fittings 18*a* and 18*b* are inclined to the corners of the first receiving portions 6*g* and 6*h* and brought into contact therewith. As a result, the frictional resistance of the contact portion becomes greater. Then, the elastic force of recovery of the first snap fittings 18*a* and 18*b* should provide a load large enough to resist such frictional resistance in order for the first snap fittings 18*a* and 18*b* to be restored to the predetermined position of engagement. The first snap fittings 18*a* and 18*b* find it difficult to return to the predetermined lock positions eventually. Then, if more shocks should be received in such condition, the hooking portions 18*c* and 18*d* of the first snap fittings 18*a* and 18*b* are caused to retract further, and the locks are dislocated after all.

Meanwhile, at the location where the second snap fittings 19*a* and 19*b* engage with the second receiving portions 6*e* and 6*f*, bending deformation occurs on the elastically displaceable portions of the second snap fittings 19*a* and 19*b* as in the case of the portion where the first snap fittings 18*a* and 18*b* engage with the first receiving portions 6*g* and 6*h*. At this time, however, the hook faces of the second snap fittings 19*a* and 19*b* are in contact with the second receiving portions 6*e* and 6*f* almost horizontally (almost in parallel). Thus, even if bending deformation occurs for the second snap fittings 19*a* and 19*b*, the contact angles for both of them show almost no change. As a result, the frictional resistance that may act on the hook faces is small when the hook faces of the second snap fittings 19*a* and 19*b* move due to the occurrence of bending deformation, and the second snap fittings 19*a* and 19*b* are able to return to the predetermined lock position immediately.

In other words, the structure is arranged as described above so that (i) when the liquid jet recording head 51 receives a shock load that acts in the bonding direction of the frame member 16 and the liquid path formation member 6, the first snap fittings 18*a* and 18*b* and the second snap fittings 19*a* and 19*b*, the extended directions of the elastically displaceable portions of which are different, are allowed to engage in order to have them work to hold the condition of engagement between the first snap fittings 18*a* and 18*b* and the elongated piece 31, and (ii) when the liquid jet recording head 51 receives a shock load that acts in the direction in which the hooks of the snap fittings are caused to displace, the second snap fittings 19*a* and 19*b* hold the condition of engagement.

Also, the positional precision in which the frame member 16 and the flow path formation member 6 are bonded is determined mainly by the engagement between the first snap fittings 18*a* and 18*b*, which have the tensile strength sufficient to withstand the load that may act in the direction in which these member are separated, and the corresponding first receiving portions 6*g* and 6*h*, thus maintaining the relative positions thereof in high precision.

On the other hand, the locking of the engaged portion between the second snap fittings 19*a* and 19*b* and the second receiving portions 6*e* and 6*f* is not easily dislocated even when receiving any shock load that may act in the direction in which the hooks of the snap fittings are caused to be displaced. Therefore, the engaged portion between the second snap fittings 19*a* and 19*b* and the second receiving portions 6*e* and 6*f* acts to maintain the locking of the engaged portion between the first snap fittings 18*a* and 18*b* and the first receiving portions 6*g* and 6*h*.

In this respect, as another means for enhancing the resistance to the force of dropping shocks and to the repulsion of the sealing member 20, it may be possible to strengthen the rigidity of the elastically displaceable portions by increasing the thickness of the elastically displaceable portions of the snap fittings. In the case of this method, however, the space needed for connecting the frame member 16 and the flow path formation member 6 will become larger in accordance with the increase in size of the snap fittings. Moreover, with the stronger bending rigidity of the snap fittings, the assembling loads are increased, degrading the assembling performance accordingly.

In other words, in accordance with the present embodiment, it is possible to strongly fix the connecting portion between the frame member 16 and the flow path formation member 6 without increasing the thickness of the elastically displaceable portions of the snap fittings. As a result, the liquid jet recording head 51 can be manufactured compactly at lower cost. Furthermore, the load that may be exerted is smaller when connecting frame member 16 and flow path formation member 6, leading to excellent productivity.

Next, the wiping operation will be described with reference additionally to FIG. 13.

As described above, recording liquid is wet and adheres to the discharge ports and the recording liquid discharge surface 1*b* of the recording liquid elemental base plate 1, and also, to the face plane 3*a* of the sheet wiring base plate 3 of the recording apparatus due to mist, satellites, or the like, generated when recording liquid is discharged from the liquid jet recording head. Also, the recording liquid that remains after suction may adhere to the liquid discharge surface 1*b* and the face plane 3*a* at the time of a suction recovery process or the like, in which recording liquid is suctioned from the discharge ports after capping.

Now, for the recording apparatus, a recovery unit that performs a wiping process is provided in order to remove recording liquid that has adhered to the recording liquid discharge surface 1*b* and the face plane 3*a*. The recovery unit is provided with a blade 41 that wipes off recording liquid by slidably moving on the recording liquid discharge surface 1*b* and the face plane 3*a*, and a carrier mechanism (not shown) that moves the blade 41.

The blade 41 is formed of rubber, elastomer, or the like, to be substantially in a flat form, and provided with elastic restoring power that enables the shape to be restored by elasticity when the leading end side is elastically deformed.

Also, if the width of the blade 41 is larger than the width (shorter side direction) of the sheet wiring base plate 3, there does not exist any area that the blade 41 cannot slide over for wiping, which makes it possible to execute the wiping operation effectively. Therefore, the width of the blade 41 should preferably be formed to be larger than the width of the sheet wiring base plate 3.

In FIG. 13, the states of the blade 41, designated by reference marks $m_1$, $m_2$, $m_3$, and $m_4$, indicate that the wiping operation begins, the blade passes the leading end portion 31*c* of the elongated piece 31, the actual wiping is in process (the blade begins to enter the face plane 3*a*), and the wiping operation terminates, respectively.

The blade 41 moves from the position (state $m_1$) where the wiping operation begins in the direction indicated by the arrow T in FIG. 13, and when the leading end side of the blade 41 is in contact with the outer wall face of the elongated piece 31, the leading end side of the blade 41 bends considerably to be elastically deformed along the leading end portion 31*c* of the elongated piece 31, thus moving slidably on the leading end portion 31*c* (state $m_2$).

Then, when the blade 41 moves further in the direction indicated by the arrow T, the leading end side enters the face plane 3*a* of the sheet wiring base plate 3 (state $m_3$).

The face plane 3*a* of the sheet wiring base plate 3 is recessed toward the flow path formation member 6 side, as compared with the leading end portion 31*c* of the elongated piece 31. Therefore, when the leading end side of the blade passes the leading end portion 31*c* of the elongated piece 31, the amount of deformation in the curved shape is reduced immediately after the step (the difference of the relative positions of the leading end portion 31*c* of the elongated piece 31 and the face plane 3*a*), and the leading end side of the blade 41 contacts and slides over the face plane 3*a*.

In this manner, when the sliding surface of the blade 41 on the leading end side moves from the leading portion 31*c* of the elongated piece 31 to the face plane 3*a*, the leading end side moves vigorously in the moving direction of the blade 41, because the leading end side itself tends to return to its original, undeformed, straight or upright configuration by its own elastic restoring force.

At this time, then, the leading end side of the blade 41 passes jumping over the end portion 3*c* of the sheet wiring base plate 3 without touching the end portion 3*c* thereof. Therefore, there is no possibility that it is hooked (caught) by the end portion 3*c* of the sheet wiring base plate 3. In other words, in accordance with the present embodiment, the liquid jet recording head 51 has no drawback that the sheet wiring base plate 3 is peeled off from the end portion 3*c* by the wiping operation of the blade 41, thus making it possible to prevent the sheet wiring base plate 3 from being damaged.

In this respect, as described above, the length of the area that the leading end portion 3*c* of the blade 41 jumps over is determined by the material (elastic restoration power) of the blade 41, the speed of movement of the blade 41, and the difference (step) of the relative positions of the leading end portion 31*c* of the elongated piece 31 and the face plane 3*a* of the sheet wiring base plate 3, among others.

Also, in accordance with the present embodiment, the step between the leading end portion 31*c* of the elongated piece 31 and the face plate 3*a* is set at 1.0 mm or less for the liquid jet recording head 51. As a result, the leading end side of the blade 41 can be elastically deformed in good condition without any particular force, and the elastic deformation on the leading end side is made changeable smoothly and in a short period of time.

As described above, the blade 41 of the liquid jet recording head 51 thus structured jumps over the inner wall face 31*e* of the elongated piece 31 and the leading end portion 3*c* of the sheet wiring base plate 3 when the blade 41 enters the face plane 3*a* of the sheet wiring base plate 3. After the jump, the leading end side of the blade 41 maintains a curved configuration. Therefore, the blade 41 is pressed against the face plane 3*a* of the sheet wiring base plate 3 immediately from the landing point of the leading end side, thus making it possible to begin the wiping operation promptly.

Under such circumstances, the liquid jet recording head 51 is able to scrape off dust particles and recording liquid adhering to the circumference of the discharge ports precisely with the leading end side of the blade 41. Then, when the blade 41 has passed the face plane 3*a* of the sheet wiring base plate 3 completely, the blade 41 returns to its original, undeformed, straight or upright configuration (state $m_4$) by its own elastic restoring power.

In accordance with the present embodiment, the recording apparatus makes it possible to form good images by stabilizing the discharge operation of the recording liquid by cleaning the face plane 3*a* of the sheet wiring base plate 3 and the circumference of discharge ports by means of a series of the wiping operations described above.

Also, the inner wall 31*e* of the elongated piece 31 is positioned on the upstream side of the starting point of the wiping operation. Therefore, recording liquid carried by the leading end side of the blade 41 is not pooled in the vicinity of the inner wall face 31*e*.

In this respect, there is no wall or extrusion that protrudes from the face plane 3*a* with the exception of the leading end portion 31*c* of the elongated piece 31 on the circumference of the sheet wiring base plate 3 as a matter of course so as to prevent the remaining recording liquid, which flows out in the widthwise direction of the blade 41 and cannot be removed, or the remaining recording liquid and other matter that cannot be removed by a one-time wiping operation, from stagnating on the area outside of the sliding contact area of the blade 41 when the wiping operation is performed.

Also, it is preferable to arrange the structure so that (i) when the leading end side of the blade 41 is in contact with the elongated piece 31 and bent, the width of the elongated piece 31 is made larger than the width of the blade 41 in order to bend it to be elastically deformed evenly over the entire area of the widthwise direction of the blade 41, and (ii) the entire area over the blade width is in contact with the elongated piece 31.

Next, with reference to FIG. 14 and FIG. 15, the description will be made of the method for positioning the liquid jet recording head 51 on the carriage 61 provided for the recording apparatus.

In FIG. 14 and FIG. 15, only a part of the bottom portion of the carriage is schematically represented, not the entire body of the carriage, for the sake of convenience.

On the bottom portion of the carriage, there is provided the opening 61*a*, which enables the liquid jet recording head 51 to be inserted. On the inner wall face of the opening 61*a*, receiving portions 61*b* and 61*c* are arranged to receive the cylindrical surface portions 2*a* and 2*b* on the liquid jet recording head 51 side, and on the upper face, receiving surfaces 61*d* and 61*e* are arranged to support the liquid jet recording head 51 in the direction in which it is inserted.

When the liquid jet recording head 51 is lowered to the bottom face portion of the carriage and inserted, the liquid jet recording head 51 is pressed in the directions indicated by arrows A, B, and C in FIG. 14 by pressurizing means (not shown) arranged on the carriage side. Therefore, the boss 6*a* of the liquid jet recording head 51 abuts against the receiving surfaces 61*d* and 61*e* of the carriage, and the cylindrical surface portions 2*a* and 2*b* of the liquid jet recording head 51 abut against the receiving portions 61*b* and 61*c* of the carriage. Further, the bosses 6*b* of the liquid jet recording head 51 abut against the predetermined receiving portions (not shown) on the carriage side. In this manner, the liquid jet recording head 51 is positioned on the carriage in high precision.

In this respect, the recording apparatus is structured to enable the frame member 16 to receive all the pressure that acts in the directions indicated by the arrows A, B, and C in FIG. 14 by pressure means provided for the carriage, and then, even if it is attempted to provide a large liquid storing means (i.e., to make the common liquid chamber 17 larger) for the liquid jet recording head 51, which necessitates a head in which the frame member 16 is made larger, there is no need for the recording unit 15 or the flow path formation member 6 to be made larger, thus making it possible to manufacture the liquid jet recording head 51 at lower cost.

Also, the cylindrical surface portions 2*a* and 2*b* (the first reference surface) of the first plate 2, serving as the assembling reference of the recording element base plate 1, can also be used as a reference portion for positioning the installation of the liquid jet recording head 51 on the carriage. Therefore, the amount of inclination of the recording element base plate 1 (the discharge port array) after the liquid jet recording head 51 is mounted on the carriage can be determined by only the value of the adjustment precision of the recording element base plate 1 based on the first reference surface of the first plate 2, added to the value of the abutting precision of the first reference surface and the receiving surfaces 61*b* and 61*c* of the carriage, hence making it possible to position the liquid jet recording head 51 on the carriage, for mounting, with extremely high precision.

Further, if the first plate 2 is formed of a rigid material, such as a ceramic material, it becomes possible to enhance the dimensional accuracy and geometric accuracy of the first plate 2 still more, thus significantly enhancing the assembling precision of the recording element base plate 1.

Also, if the first plate 2 is formed of a rigid material, there is no possibility that, when the liquid jet recording head 51 is mounted on the carriage, the load that may be exerted will deform the first reference surface of the first plate 2. As a result, the precision of the abut-positioning becomes extremely high. Moreover, even if the liquid jet recording head 51 is often mounted on or removed from the carriage, the reference surface of the first plate 2 is excellent in resistance to wear. Therefore, the inclination accuracy of the discharge port arrangement portion of the liquid jet recording head can be reproduced in good condition when mounted on the carriage, and the positioning is performed precisely, thus enhancing the reliability of the recording apparatus as a whole.

Also, the first plate 2 is formed of alumina having high capacity for heat radiation. Then, even if the liquid jet recording headis arranged in high density, whereby the temperature increases easily, the temperature characteristics of the liquid jet recording head as a whole are improved. Furthermore, being excellent in chemical resistance with high rigidity, alumina makes it possible to perform highly precise machining. Therefore, alumina suitably provides various characteristics needed for the first plate 2, and serves as a preferable material for the first plate 2.

As described above, when the liquid jet recording head 51 is mounted on the carriage, reference portions for positioning in all the three-dimensional directions are provided for the recording unit 15. With this arrangement, it becomes possible to reduce the errors resulting from the accumulation of members, and the accumulated dimensional errors of the members provided for positioning the recording element base plate 1 with the first plate 2 or the flow path formation member 6. As a result, the positioning accuracy is significantly enhanced for the discharge ports when the liquid jet recording head 51 is mounted on the carriage.

When the mechanisms required for the recording unit 15 and the liquid jet recording head 51 are put together in such a manner, it becomes possible to make the reliability of the dimensional reference portions of the liquid jet recording head 51 extremely high by selecting materials that may provide high-mechanical strength in high precision, and by adopting mechanical structures accordingly.

On the other hand, with respect to the frame member 16, it is possible to select inexpensive materials within a range that provides desired properties for the first snap fittings 18*a* and 18*b*, the second snap fittings 19*a* and 19*b*, and the elongated piece 31. Therefore, the required functions of the recording unit 15 are intensively formed with a minimum size. Also, inexpensive material is used for all the other portions of the frame member 16 as required. In this way, a high-performance liquid jet recording head 51 can be manufactured at lower cost.

Also, in positioning the liquid jet recording head 51, the inclination of the discharge ports in the arrangement direction is most important. In this respect, the assembling reference of the recording element base plate 1, and the installation reference for installing the liquid jet recording head 51 on the carriage, can be set equally. Therefore, even for the recording apparatus for which the liquid jet recording head 51 is attached to and detached from the carriage 61 repeatedly, the installation of the discharge ports can be maintained in high precision at all times.

Furthermore, if the structure is arranged so that all the members that form the liquid jet recording head are assembled with reference to the positioning reference applicable at the time of mounting on the carriage, the liquid jet recording head 51 can be manufactured with higher precision.

So far, one mode of the liquid jet recording head and recording apparatus of the present invention has been described. The present invention is of course applicable to any mode of the recording apparatus in which only a single liquid jet recording head 51 is mounted on the carriage or plural liquid jet recording heads 51 are mounted on the carriage.

Also, the structure may be arranged so that the positioning references in all the three-dimensional directions are arranged for the flow path formation member 6 when the liquid jet recording head 51 is mounted on the carriage. In other words, with the positioning references being put together for one member, members in high precision and members in low precision are distinctly separated, hence making it possible to enhance productivity.

Also, the elastically displaceable portions of the second snap fittings 19*a* and 19*b* extend in a direction at right angles to the connecting direction of the frame member 16 and the flow path formation member 6. However, the same effect is obtainable by a structure in which the elastically displaceable portions of the second snap fittings 19*a* and 19*b* extend in a direction inclined at an angle of 45 degrees or more to the connecting direction of the frame member 16 and the flow path formation member 6.

Also, in accordance with the present embodiment, the recording unit 15 and the frame member 16 are connected with the sealing member 20 being nipped between them. However, the present invention is also applicable to the mode in which the liquid jet recording head is structured without any arrangement of the sealing member 20 on the connecting portion, but rather is structured to be airtightly closed by use of sealant or the like.

Figure 16:
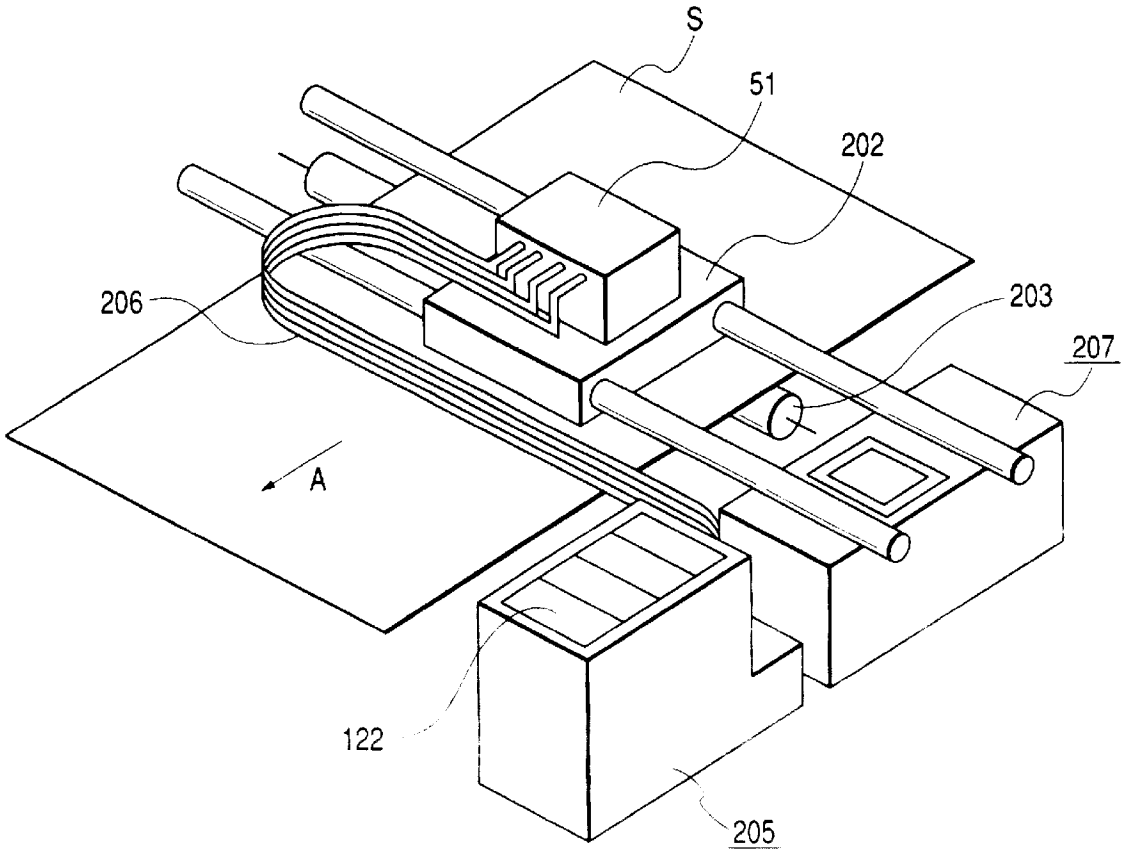
FIG. 16 is a perspective view that schematically shows the structure of the recording apparatus in accordance with one embodiment of the present invention.

Next, FIG. 16 is a perspective view that schematically shows one structural example of the recording apparatus on which the liquid jet recording head of the present embodiment is mountable.

The recording apparatus shown in FIG. 16 is a recording apparatus of the serial type in which the reciprocal movement (main scans) of the liquid jet recording head 51, and the conveyance (sub-scans) per designated pitch of a recording sheet S, such as a general recording sheet, specially treated sheet, OHP film, are repeated, and in synchronism with such movement, recording liquid is selectively discharged from the liquid jet recording head 51 for the adhesion thereof to the recording sheet S, thus forming characters, symbols, images, and the like thereon.

In FIG. 16, the liquid jet recording head 51 is detachably mounted on the carriage 202, which is slidably supported by two guide rails to reciprocate along the guide rails by driving means (not shown), such as a motor. The recording sheet S, facing the recording liquid discharge surface of the liquid jet recording head 51, is conveyed, by use of a conveying roller 203, in the direction intersecting the traveling direction of the carriage 202 (that is, the orthogonal direction indicated by the arrow A, for example), so as to maintain a constant distance to the recording liquid discharge surface.

The liquid jet recording head 51 is provided with plural nozzles arrays for discharging recording liquid of different colors, respectively. Corresponding to the colors of recording liquid discharged from the liquid jet recording head 51, plural independent recording liquid storing tanks 122 are detachably installed on the recording liquid supply unit 205. The recording liquid supply unit 205 and the liquid jet recording head 51 are connected by plural recording liquid supply tubes 206 corresponding to various colors of recording liquid, and when the recording liquid storing tanks 122 are installed on the recording liquid supply unit 205 recording liquid of each color contained in the recording liquid storing tanks 122, respectively, can be supplied individually to each nozzle array of the liquid jet recording head 51.

Within the range of reciprocation of the liquid jet recording head 51, but in the non-recording area, which is outside of the conveying range of the recording sheet S, the recovery unit 207 is arranged to face the recording liquid discharge surface of the liquid jet recording head 51.

As described above, in accordance with the present invention, the porous member is arranged above the bottom face of the common liquid chamber. Therefore, recording liquid in the common liquid chamber is agitated to enable colorant in the recording liquid, dust particles and the like, accumulated on the surface of the porous member to ride and be carried by the flow of recording liquid. With the structure thus arranged, it is made difficult for colorant, dust particles, and the like, accumulated on the bottom face of the common liquid chamber, to accumulate again on the surface of the porous member. In other words, in accordance with the present invention, it is made possible to prevent recording from being disabled due to clogging of the porous member, which may block the arrival of recording liquid to the discharge port portion and make impossible the discharge of recording liquid from the discharge ports of the liquid jet recording head.

What is claimed is:

1. A liquid jet recording head comprising:

a recording liquid flow path communicating with a plurality of discharge ports for discharging recording liquid;

a common liquid storing chamber provided with a chamber for directly storing the recording liquid supplied to said recording liquid flow path;

an upper plug member as an expelling path for expelling air in said common liquid storing chamber;

a lower plug member as a supply path for supplying the recording liquid into said chamber from the outside; and a filter held at an end portion of said common liquid storing chamber to remove dust particles and other matter in the recording liquid supplied from said chamber to said recording liquid flow path, wherein in use of said liquid jet recording head said filter is provided in a leading end of a filter holding member projecting above a bottom portion of said chamber, and said filter is provided close to said lower plug member so that the distance between said filter and said lower plug member is shorter than the distance between said filter and a surface opposed to a side face of said common liquid storing chamber where said lower plug member is provided, wherein a surface of said filter is extruded to be (i) spherical in a flow-in direction of the recording liquid into said filter and (ii) convex with respect to said filter holding member, wherein, in said common liquid storing chamber, said leading end of said filter holding member which supports said filter has a projecting shape toward said common liquid storing chamber, and wherein, when the recording liquid is supplied through said lower plug member into said chamber, a flow of the recording liquid is induced in the chamber in a direction from said lower plug member toward said upper plug member, the flow going over said surface of said filter, whereby colorant of the recording liquid deposited on said surface of said filter is agitated so as to be separated from said surface of said filter, and to float in the recording liquid and/or to drop toward the bottom portion of said chamber.

2. A liquid jet recording head according to claim 1, wherein said lower plug member is an elastic element arranged to deal with switching of the supply condition of the recording liquid from the outside into said chamber between a supplying state and a non-supplying state.

3. A liquid jet recording head according to claim 2, wherein the height from a bottom face of said chamber to said filter is at least greater than the height from the bottom face of said chamber to said lower plug provided for the side face of said common liquid storing chamber.

4. A liquid jet recording apparatus having a liquid jet recording head according to claim 1 mounted thereon to record by discharging the recording liquid to a recording medium, comprising:

a carriage for detachably mounting said liquid jet recording head;

a recording liquid storing tank provided outside of said carriage for storing the recording liquid to be supplied to said chamber of said liquid jet recording head; and supply means for supplying the recording liquid stored in said recording liquid storing tank to said chamber through either one of said plug members.

* * * * *